US005365261A

United States Patent [19]

Ozawa et al.

[11] Patent Number: 5,365,261

[45] Date of Patent: Nov. 15, 1994

[54] TRANSFER TYPE INK JET PRINTER

[75] Inventors: Yoshiyuki Ozawa; Hideo Yamazaki; Makoto Fujino; Tohru Fukushima; Yoshinori Miyazawa, all of Nagano, Japan

[73] Assignee: Seiko Epson Corporation, Tokyo, Japan

[21] Appl. No.: 34,484

[22] Filed: Mar. 19, 1993

[30] Foreign Application Priority Data

| | | | |
|---|---|---|---|
| Mar. 19, 1992 | [JP] | Japan | 4-063288 |
| Jun. 4, 1992 | [JP] | Japan | 4-144444 |
| Jun. 29, 1992 | [JP] | Japan | 4-170332 |
| Oct. 16, 1992 | [JP] | Japan | 4-278937 |
| Dec. 7, 1992 | [JP] | Japan | 4-326912 |

[51] Int. Cl.[5] ..... B41V 2/01

[52] U.S. Cl. ..... 347/103

[58] Field of Search ..... 346/25, 21, 140; 355/273, 256–258, 261

[56] References Cited

U.S. PATENT DOCUMENTS

| | | | |
|---|---|---|---|
| 3,898,670 | 8/1975 | Erikson | 346/21 |
| 3,972,611 | 8/1976 | Tanaka | 355/256 |
| 4,538,156 | 8/1985 | Durkee et al. | 346/140 R X |
| 5,099,256 | 3/1992 | Anderson | 346/140 R X |
| 5,119,140 | 6/1992 | Berkes | 355/273 |

FOREIGN PATENT DOCUMENTS 3811141 10/1988 Germany .

OTHER PUBLICATIONS

*Patent Abstracts of Japan,* vol. 14, No. 281 (M-986), 1990.

*Primary Examiner*—Joseph W. Hartary

*Attorney, Agent, or Firm*—Sughrue, Mion, Zinn, Macpeak & Seas

[57] ABSTRACT

A transfer type ink jet printer having an ink jet head for ejecting droplets of ink in which charged coloring particles have been dispersed in a solvent in the form of insulating carrier liquid having a low dielectric constant, a transfer medium for carrying and moving an ink image formed of ink droplets ejected from the head, and a pressure roller for transferring the ink image written to the transfer medium to a recording medium. By temporarily fixing the charged coloring particles in the ink image onto the transfer medium until the ink image is led to the transfer means after the ink image is formed on the transfer medium, good and high-speed image printing has been made possible without vapor generation, so that an excellent image free from any printing pattern is available at a low transfer pressure. There is also provided a unit for removing a solvent by making the solvent on the transfer medium with the charged coloring particles temporarily fixed by the means for temporarily fixing the particles contact water or a surface active aqueous liquid agent.

21 Claims, 12 Drawing Sheets

TRANSFER TYPE INK JET PRINTER

BACKGROUND OF THE INVENTION

1. Field of the Invention

The present invention relates generally to ink jet printers for forming ink images on recording media and more particularly to a transfer type ink jet printer for transferring an ink image to a recording medium by pressing a transfer medium against the recording medium face to face after forming the ink image on the transfer medium.

2. Related Art

A printer of the sort disclosed by, for instance, U.S. Pat. No. 4,538,156 is known as a conventional transfer type ink jet printer.

This printer is, as shown in FIG. 25, designed to transfer an ink image by pressing recording paper 12 against the ink image formed by a recording head 11 on the surface of a cylindrical transfer medium 10. The residual ink left untransferred is removed by a cleaner 13.

The conventional transfer type ink jet printer has put it in question that the quality of the image thus transferred is not always good.

In the first place, the reason for this is that when the ink image formed of liquid ink makes contact with the recording paper, the liquid ink soaks along the fibers, thus allowing whiskers to grow on the periphery of the ink image.

In the second place, the reason is that since the image transfer is effected by the contact between the transfer medium and, the recording paper, an recessed portion of the recording paper will not contact the transfer medium if the smoothness of the recording paper is poor, and there appears a so-called "whitening" phenomenon in which an image to be transferred is not transferred.

In view of these problems, the present applicants propose in Japanese Patent Laid-Open No. 92849/1987 an apparatus for transferring an ink image to recording paper by ejecting ink droplets to a transfer medium once and evaporating a solvent composition in the ink droplets in order to press the concentrated ink image against the recording paper. This apparatus is, as shown in FIG. 26, designed to transfer an image by pressing a transfer medium 22 to which ink has been ejected from a recording head 21 against a recording medium 25 supported with a roller 24; in this case, a heater 23 is used to accelerate the evaporation of a solvent composition in the ink. The transfer medium 22 after the transfer operation is cleaned with a brush and dried by a blower 27 to keep the surface condition constant.

With this apparatus, the ink image is prevented from deforming while it is being transferred or from soaking into the recording medium 25 since the concentrated ink image is transferred to the recording medium 25. Therefore, clear image formation can be made possible by solving the problems characteristic of transfer type ink jet printers.

U.S. Pat. No. 5,099,256 also proposes an apparatus for transferring ink to recording paper by ejecting ink droplets to a transfer medium once and evaporating the solvent composition in the ink droplets in order to press the concentrated ink against the recording paper. This apparatus is, as shown in FIG. 27, designed to transfer an image by pressing a transfer medium 32 onto which ink has been ejected from a recording head 31 against a recording medium 35 supported with a roller 34; in this case, a heater is used to accelerate the evaporation of a solvent composition in the ink.

With this apparatus, the ink image is prevented from deforming while it is being transferred or from soaking into the recording medium 35 since the concentrated ink is transferred to the recording medium 35. Therefore, clear image formation can be made possible by solving the problems characteristic of transfer type ink jet printers.

However, these apparatus still have the following problems to solve from the viewpoint of the use of such a heater for thickening ink.

In the first place, it will take time during the process of evaporating the solvent composition if the heater temperature is low, whereas though the solvent composition may be evaporated for a short time at high temperatures, power consumption tends to increase as the heater temperature is raised. Further, it will still take time to raise the set temperature. In other words, the problem is that a demand for high-speed printing has not been satisfied.

In the second place, the inside of the apparatus may be contaminated since the solvent steam is discharged into the apparatus as the solvent evaporates.

In the third place, there arises a problem in that the transfer pressure may increase. More specifically, the time required from the ejection of ink up to the transfer of an image tends to vary with the spot when one nozzle head or a multiple nozzle head is used for scanning even though it is attempted to specify the concentrated ink condition by setting the quantity of heat at a proper value. This means there occurs a disparity in the concentrated ink condition. In this case, the relationship between the concentrated ink image condition and the transfer pressure is such that the greater the concentration of the ink used to form the imager the greater the transfer pressure becomes. It is therefore necessary to set the pressure value in conformity with the maximum concentration of the ink used for forming the image and this tends to require an excessive pressure. Further, an excessive transfer pressure may also be required as the concentration of the ink used for forming the image varies with the printing pattern of the ink image, that is, the amount of ink per unit area.

SUMMARY OF THE INVENTION

In view of the foregoing problems, it is therefore an object of the present invention to provide a transfer type ink jet printer capable of high-speed printing as well as high-quality image printing.

It is another object of the present invention to provide a transfer type ink jet printer ensuring that a good image is obtainable without causing no generation of solvent steam, without being affected by a printing pattern, at a low transfer pressure.

A printer according to the present invention comprises an ink jet type record/write means for ejecting droplets of ink in which charged coloring particles have been dispersed in a solvent in the form of insulating carrier liquid having a low dielectric constant, a transfer medium for carrying and moving an ink image formed of ink droplets ejected from the ink jet type record/write means, a transfer means for transferring the ink image written to the transfer medium on a recording medium by making the recording medium contact the transfer medium, and a means for temporarily fixing the charged coloring particles in the ink image on the transfer medium until the ink image is led to the transfer means after the ink image is formed on the transfer medium.

The printer should preferably be provided with a means for removing a solvent on the transfer medium with the charged coloring particles temporarily fixed by the means for temporarily fixing the particles. The means for removing a solvent may have a solvent-adsorbent roller having excellent wetting properties with respect to the solvent while rotating in contact with the transfer medium and a solvent-removing roller set opposite to the transfer medium and used for squeezing the solvent. Further, a means for recovering the solvent thus squeezed out may be provided between the solvent-removing roller and the transfer medium.

Moreover, there may be provided a means for applying the solvent to the ink image with the charged coloring particles temporarily fixed by the means therefor and a solvent-thickness regulating means for making the thickness of the solvent constant. This means for applying the solvent may have a solvent container for containing the same solvent as what is contained in the ink and a head for applying the solvent, the head having a slit through which the solvent in the solvent container is applied to the ink image. The solvent-thickness regulating means, which is situated in the solvent container, may have a roller for regulating the thickness of a solvent to be applied, a peeling plate for removing a solvent adhering to the surface of the roller for regulating the thickness thereof, and race rings attached to both ends of the roller therefor. Further, the means for applying the solvent may be situated opposite to the transfer medium via a very small gap and may have a slit through which the solvent supplied through the solvent supply slit to the surface of the transfer medium is recovered.

Further, the means for removing a solvent may have a hole diameter sufficiently smaller than the size of charged coloring particles and is made of a material in the form of a roller for sucking and abosrbing the solvent, or may be in the form of a roller having a metal mesh layer on the surface and a means for applying voltage between the metal mesh layer and the transfer medium.

Further, the solvent-removing means should preferably be provided with a means for recovering the solvent. The solvent-removing means may have a cylindrical support, and a number of metal pins having excellent wetting properties with respect to the solvent, the pins being provided on the surface of the support. The means for recovering the solvent may be arranged so that it has a number of small holes provided pin-to-pin in the support, a port arranged in the support and used for blowing air toward the small holes, and a container for recovering the solvent thus blown thereby.

Further, the solvent-removing means may be arranged so that the solvent with the charged coloring particles temporarily fixed on the transfer medium is removed by making the solvent contact water or a surface active aqueous liquid agent and should preferably be provided with a device for recovering the solvent from the water or the surface active aqueous liquid agent in the solvent-removing means. Moreover, the solvent-removing means may be situated opposite to the transfer medium via such a very small gap and may have a slit through which the water or the surface active aqueous liquid agent supplied to the surface of the transfer medium by means of the supply slit is recovered. The device for recovering the solvent may be formed of a rotatable solvent-adsorbent material.

The transfer medium may have a transfer drum or a transfer belt, whereas the means for temporarily fixing the particles should preferably be a means for irradiating the ink image with ions. In this case, the ions should preferably have the same polarity as that of the charged coloring particles.

DETAILED DESCRIPTION OF THE PREFERRED EMBODIMENTS

Embodiments of the present invention will be described with reference to the accompanying drawings.

FIRST EXAMPLE

Figure 1:
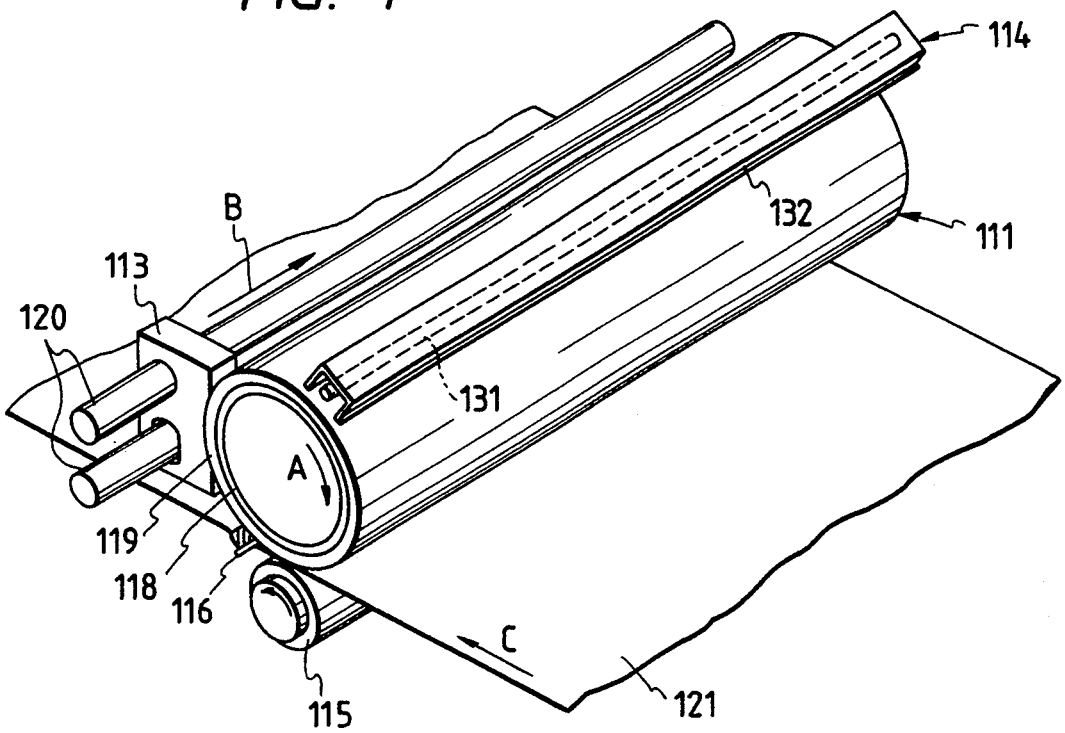
FIG. 1 is a perspective view of a first example.

FIG. 1 is a perspective view of a first example.

A ink jet printer of FIG. 1 comprises a recording head 113 as an ink jet type record/write means, a corona charger 114 as a temporarily-fixing means, a pressure roller 115 as an ink image transfer means, and a cleaning blade 116, these being arranged around a rotatable transfer drum 111 as a transfer medium successively in the direction of rotation of the transfer drum from the upper part thereof.

The transfer drum 111 is formed with a conductive elastic layer 119 around a primary metal pipe 118. The conductive elastic layer 119 may a rubber member in which a conductive compound of carbon black or metal powder has been dispersed. The transfer drum 111 is rotated by a drive means (not shown) in the direction of an arrow A.

The recording head 113 is, as shown in FIG. 1, an ink jet head of such a type that it carries out scanning along carriage shafts 120 in the direction of an arrow B. The recording head 113 is an ink jet recording head of such a type that it employs piezoelectric elements and ejects ink droplets from a plurality of nozzles in response to a recording signal.

The transfer drum 111 stops to operated during the operation of the recording head 113 and rotates intermittently as the recording head 113 turns when it changes its direction at the end of the scanning portion.

Figure 2:
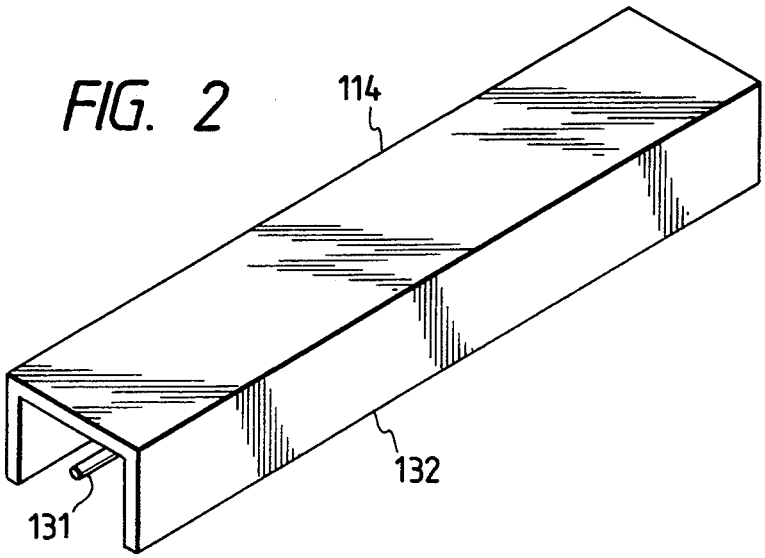
FIG. 2 is a perspective view of a corona charger 114.

The corona charger 114 is an ion generator by means of Corotrons. As shown in FIG. 2, a stainless housing 132 is used to shield a tungsten wire 131 which is 0.05 mm in diameter and set apart by about 5 mm from the stainless housing. In this case, a high-tension power supply (not shown) is used to apply a high voltage of −5 kV to the tungsten wire 131 so as to generate negative corona ions.

The cleaning blade 116 is an elastic body of rubber or the like which is pressed against the transfer drum 111.

Recording paper 121 as the recording medium is conveyed in the direction of an arrow C to keep contact with the transfer drum 111 while being pressed by the pressure roller 115 from the back.

Ink for use is emulsion ink in which charged coloring particles have been dispersed in a solvent containing high-resistant carrier liquid having a low dielectric constant. The solvent may contain, for example, ISOPAR-G of Exxon Chemical Corporation, Microlith Black C - T of Chiba-Geigy (Japan) Ltd. as charged coloring particles, and ethylene ethyl acrylate as resin. The ink also contains lecithin as a charge control agent together with the charged coloring particles as a solvent. The charged coloring particles in the ink used in this example are negatively charged.

The operation will subsequently be described.

Ink droplets are first ejected from the recording head 113 and an ink image is formed on the surface of the transfer drum 111. Then the ink image is irradiated with corona ions by the corona charger 114 and the charged coloring particles are temporarily fixed on the transfer drum 111 where the ink image is separated into the charged coloring particles and the solvent.

Figure 3:
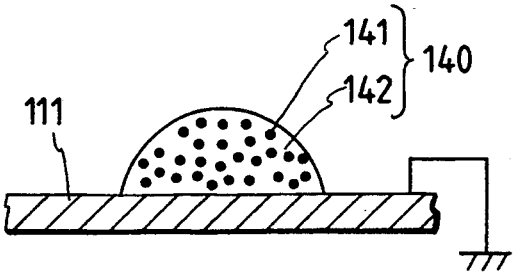
FIG. 3 is a diagram illustrating the operation of temporarily fixing ink and that of separating it in the first example.
Figure 4:
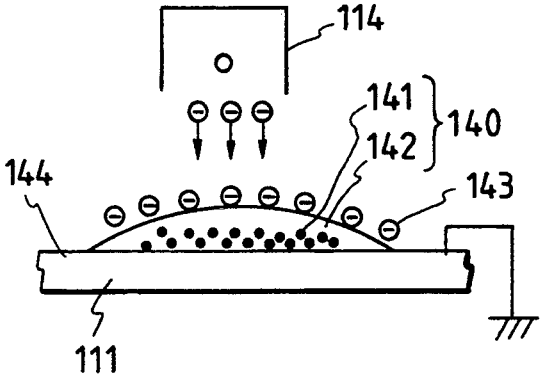
FIG. 4 is a diagram illustrating the operation of temporarily fixing ink and that of separating it in the same.

Referring to FIGS. 3 and 4, a detailed description will be given of the temporary fixation of the charged coloring particles onto the transfer drum 111 and the separation of the ink image by means of corona charger 114. With this embodiment, the charged coloring particles 141 have been negatively charged, whereas the transfer drum 111 has been grounded. The ink image 140 formed by the recording head 113 is such that the charged coloring particles 141 therein have been dispersed uniformly in the solvent 142 as shown in FIG. 3. When negatively charged corona ions are thrown by the corona charger 114 onto the ink image 140, the surface of the ink image 140 is charged negatively as shown in FIG. 4 and the charged coloring particles 141 are caused to stick to the transfer drum 111 under the influence of electrostatic force. At this time, the solvent 142 decreases in the direction of height of the ink image 140 and simultaneously expands in proportion to the contact area between the ink image 140 and the transfer drum 111. While holding the contact area between the ink image 140 and the transfer drum 111 in FIG. 3, the charged coloring particles 141 move in the direction of surface of the transfer drum 111, thus causing the ink image 140 to be concentrated in a portion close to the transfer drum 111. When the ink image 140 in which the charged coloring particles 141 have been dispersed is irradiated with ions, the charged coloring particles 141 are separated into the charged coloring particles 141 temporarily fixed onto the transfer drum 111 and the solvent 142. Although a portion without the presence of the ink image 140 on the transfer drum 111 is also irradiated with ions, it will never charged as the transfer drum 111 is conductive.

The ink image 140 with the charged coloring particles 141 temporarily fixed onto the transfer drum 111 and separated from the solvent 142 is subsequently transferred to the recording paper 121 pressed via the pressure roller 115 against the transfer drum 111; at this time, a transfer bias may be applied thereto. When the ink image with the charged coloring particles 141 separated from the solvent 142 comes into contact with the recording paper 121, the solvent 142 quickly soaks into the recording paper 121, whereas the charged coloring particles 141 remain on the recording paper 121 to form an image to be recorded. Since the charged coloring particles 141 are temporarily fixed onto the transfer drum 111 while separated from the solvent 142, only the solvent 142 is first allowed to soak into the recording paper. As a result, the charged coloring particles 141 is prevented from soaking along the fibers of the recording paper 121 when the ink image 140 contacts the recording paper, thus preventing whiskers from growing on the periphery of the ink image.

After the ink image 140 is transferred to the recording paper 121, the residual transfer ink on the transfer drum 111 is removed by the cleaning blade 116 pressed against the transfer drum 111, whereby a new image is subsequently formed by the recording head 113.

The present inventors employed ink with 300 $\mu$C/g of charged coloring particles 141 dispersed therein in terms of an amount of charged corpuscles for a transfer drum 111 having an outer diameter of 110 mm, irradiated the ejected ink with negative corona ions by means of the corona charger 114 and further press-transferred the ink image to the recording paper 121. The image thus transferred proved excellent. Although negatively charged coloring particles 141 were irradiated with negative ions in this example, the present invention is not limited to this case and any effect similar thereto is made achievable by a polarity combination of charged coloring particles and ion irradiation.

SECOND EXAMPLE

Figure 5:
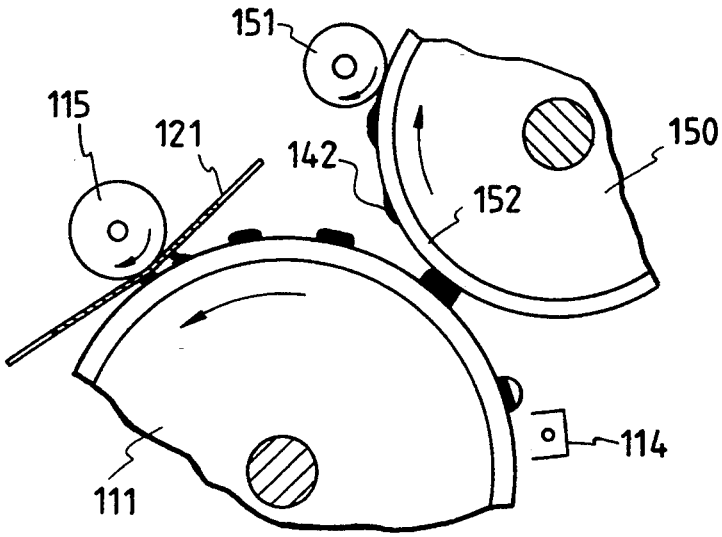
FIG. 5 is a partial side view of the principal part in a second example.

FIG. 5 is a partial side view of the principal part in a second example.

The second example is different from the first example as follows: a solvent-adsorbent roller 150 having excellent wetting properties with respect to the solvent 142 is arranged in such a way that it is rotated while being made to slightly contact the transfer drum 111 on the downstream side of the corona charger 114 for irradiating the transfer drum 111 with ions in order to remove the solvent 142 by making the solvent 142 on the transfer drum 111 adsorb the solvent-adsorbent roller 150.

With this arrangement, the electrostatic adhesion force of the charged coloring particles 141 in the ink image acts with the transfer drum 111, so that a concentrated ink image free from the solvent 142 is obtained in the downstream side of the solvent-adsorbent roller 150.

In FIG. 5, numeral 151 denotes a cleaner for removing the solvent 142 adsorbed into the solvent-adsorbent roller 150.

The second example has the same construction as that of the first example, except for the provision of the solvent-adsorbent roller 150.

THIRD EXAMPLE

Figure 6:
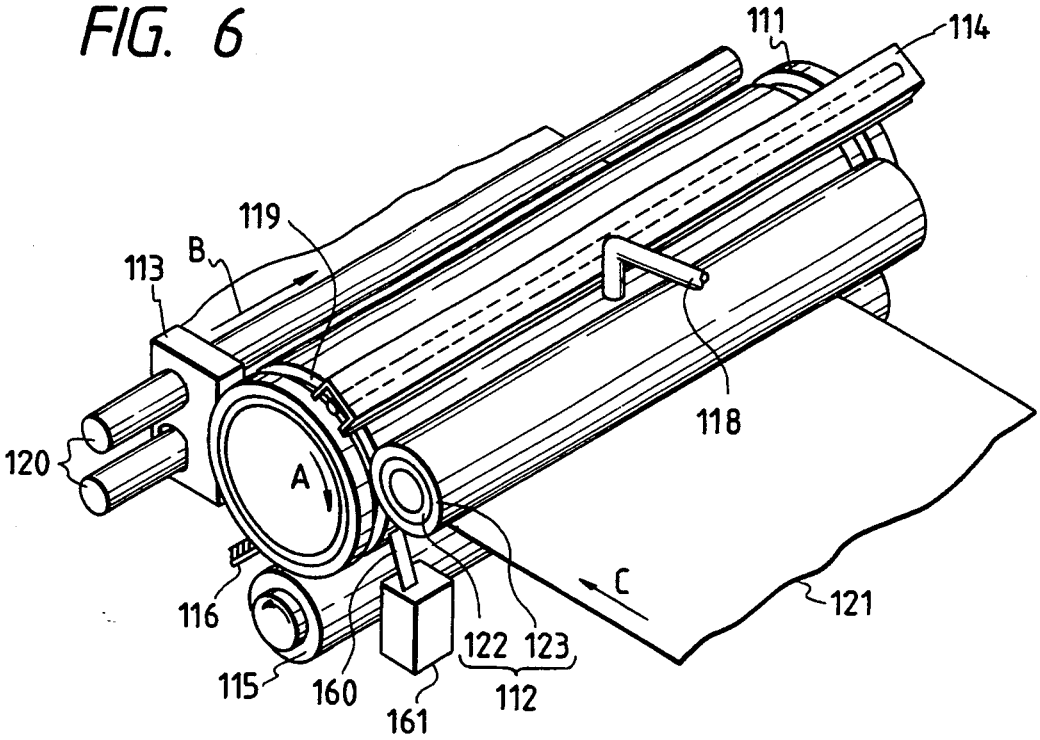
FIG. 6 is a perspective view of a third example.

FIG. 6 is a perspective view of a third example.

What makes this third example different from the first example lies in the fact that a solvent-removing roller 112 having an elastic layer 123 around a metal pipe 122 is provided on the downstream side of the corona charger 114 for irradiating the transfer drum 111 with ions.

With this arrangement, the ink image with the charged coloring particles 141 temporarily fixed onto the transfer drum 111 and separated from the solvent undergoes the squeeze action when it passes a portion where it is in contact with the solvent-removing roller 112, the solvent being squeezed from the image before being left on the upstream side of that portion. The charged coloring particles in the ink image are allowed to pass through the contact portion as there exists the electrostatic adhesion force with respect to the transfer drum 111. As a result, a concentrated ink image with the solvent removed is obtainable in the downstream side of the contact portion.

An air jet means 118 is used for recovering the residue solvent on the upstream side of the contact portion. In other words, the air jet means 118 is used to recover the residue solvent into a solvent recovery container 161 by jetting air to the upstream side of the contact portion to lead the solvent to a groove 119 provided at the end of the transfer drum 111 and by scratching the solvent thus led to the groove 119.

The third arrangement is entirely the same as the first one except the provision of the aforementioned solvent-removing roller 112.

In the aforementioned second and third examples, it has been made possible to suppress the evaporation of the solvent on the recording paper by temporarily fixing the charged coloring particles onto the transfer drum 111, separating the charged coloring particles from the solvent, and removing the solvent therefrom before the transfer of the image.

As set forth above, the first through third examples relates to the process of separating the charged coloring particles temporarily fixed onto the transfer medium from the solvent by irradiating with ions the ink image formed by the ink jet record/write means on the transfer medium. Consequently, these examples have the effect of forming and recording a clear image free from ink oozing out through the recording medium thereon.

Moreover, the above action of separating the charged coloring particles from the solvent is performed electrostatically so as to make the ink separation possible for a short time. In this way, a demand for high-speed printing can be dealt with.

FOURTH EXAMPLE

Figure 7:
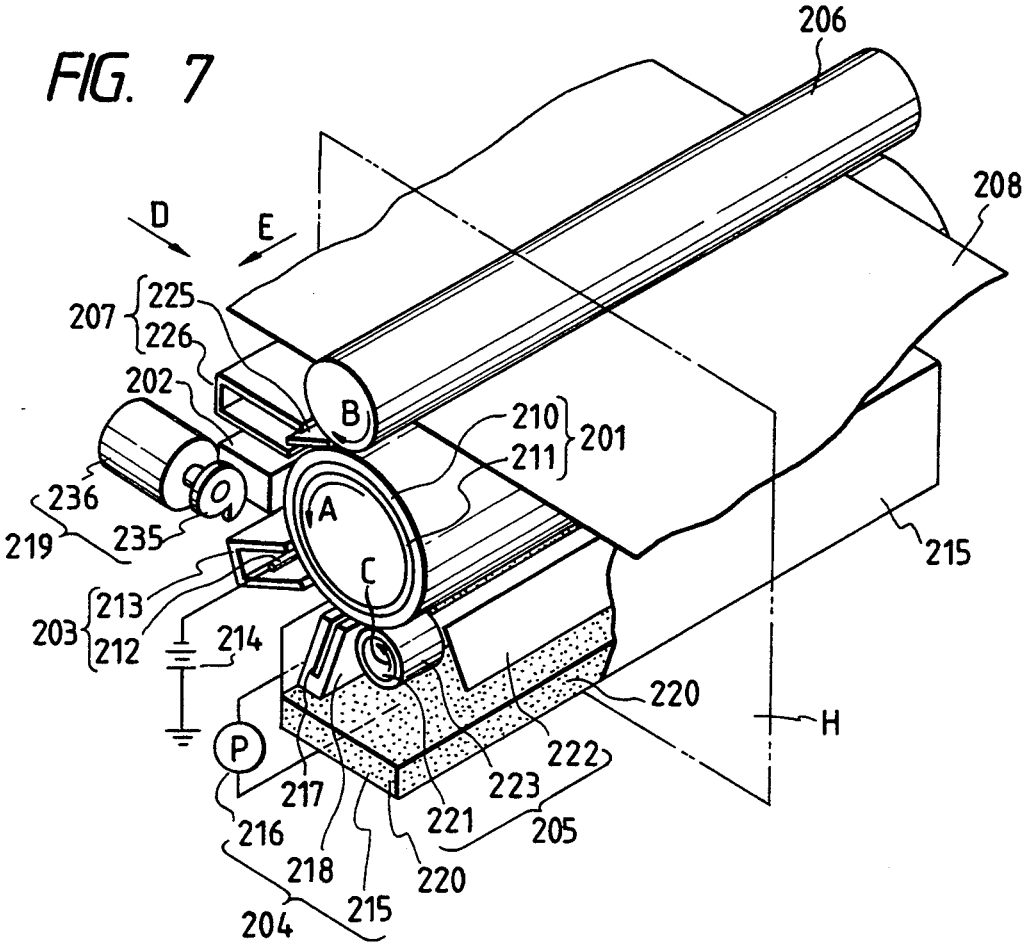
FIG. 7 is a perspective view of a fourth example.
Figure 8:
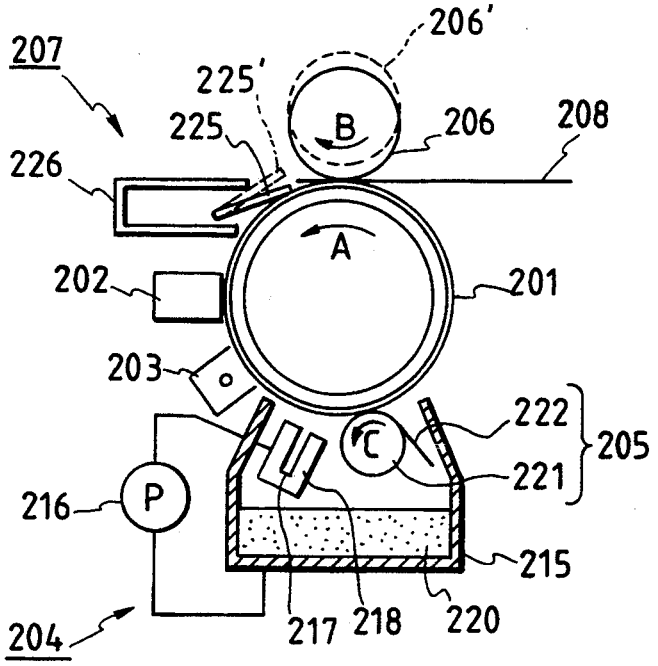
FIG. 8 is a sectional view of the fourth example taken on an imaginary plane H of FIG. 7.

FIG. 7 is a perspective view of a transfer type ink jet printer as a fourth example. FIG. 8 is a sectional view of the fourth example taken on an imaginary plane H of FIG. 7.

This printer comprises a recording head 202 as an ink jet type record/write means, a corona charger 203 as a temporarily-fixing means, a means 204 for applying a solvent, a means 205 for regulating the thickness of a solvent, a pressure roller 206 as an ink image transfer means, and a transfer drum cleaning device 207, these being successively arranged around a transfer drum 201 as a transfer medium.

Like what has been described in the first example, the transfer drum 201 is formed with a conducive elastic layer 211 around a metal pipe 210. The transfer drum 201 is supported in such a way that it is rotatable in direction of arrow A with a fixed gap over the recording head 202.

The recording head 202 is an ink jet recording head of such a type which employs a piezoelectric element and provided with a plurality of nozzles arranged in the axial direction of the transfer drum 201 at fixed intervals.

The corona charger 203 is an ion generator by means of Corotrons. A stainless housing 213 is used to shield a tungsten wire 212 which is 0.05 mm in diameter and set apart by about 7 mm from the stainless housing. In this case, a high-tension power supply is used to apply a high voltage of −5 kV to the tungsten wire 212 so as to generate negative corona ions.

The means 204 for applying a solvent includes a container 215 for containing a solvent 220 for ink, a pump 216, and a head 218 for applying the solvent, the head having a slit 217 which is arranged opposite to the transfer drum 201.

A means 205 for regulating the thickness of a solvent is accommodated in the solvent container 215 includes a roller 221 for regulating the thickness of the solvent, a peeling plate 222 for removing a solvent adhering to the surface of the roller 221 for regulating the thickness of the solvent, and race rings 223 respectively fitted to the ends of the roller 221 for regulating the thickness of the solvent.

The pressure roller 206 is an aluminum roller, which is so controllable that it may be pressed against or released from the transfer drum 201 by a means for applying pressure thereto (not shown). While the pressure roller 206 is pressed against the transfer drum 201, it rotates at the same velocity as the peripheral speed of the transfer drum 201 via recording paper 208 as a recording medium in direction of arrow B.

The transfer drum cleaning device 207 includes a cleaning blade 225 of urethane rubber and a housing 226. The cleaning blade 225 is connected to a drive means (not shown) and has an edge so arranged that it may be brought into contact with or released from the surface of the transfer drum 201.

Ink for use is such that charged coloring particles have been dispersed in the solvent prepared from insulating carrier liquid having a low dielectric constant, that is, ISOPAR-L of Exxon Chemical Corporation. The charged coloring particles contain RAVEN 1255 of Columbian Carbon Co. as pigments and ethyl cellulose as resin, these together with a charge control agent being dispersed in ISOPAR-L and negatively charged. The charged coloring particles are also arranged so that the solid concentration is set at 25 wt %.

The operation will subsequently be described.

In the initial state where no recording signal is input, the pressure roller 206 and the cleaning blade 225 of the transfer drum cleaning device 207 are so held as to be pressed against or released from the transfer drum 201. In FIG. 8, solid lines designate a state in which the pressure roller 206 and the cleaning blade 225 are pressed against or kept in contact with the transfer drum 201, whereas broken lines 206', 225' indicate that they are released therefrom; in the initial state, they are held in position as indicated by the broken lines.

Figure 9:
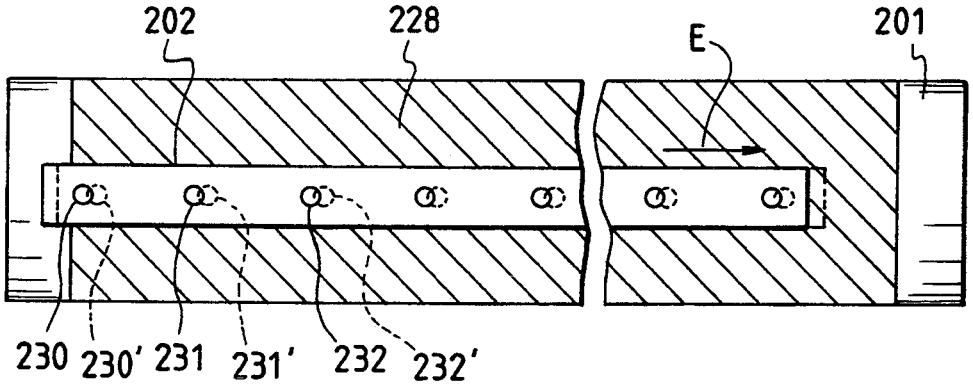
FIG. 9 is a sectional view taken on arrow lines D of FIG. 7.

When the recording signal is input to the recording head 202 in that state, an ink image is formed on the outer peripheral surface of the transfer drum 201. Referring to FIGS. 7, 9, the operation of forming the ink image by means of the recording head 202 will be described. FIG. 9 shows the recording head 202 viewed from an arrow D of FIG. 7. The recording head 202 has a plurality of nozzles 230, 231, 232,. . . arranged in conformity with the axial direction of the transfer drum 201 (in direction of arrow E of FIG. 7) at a pitch of $8\times1/300$ inch, ink droplets being ejected from the plurality of nozzles 230, 231, 232 selectively in response to the recording signal. The recording head 202 thus arranged is 1/300-inch moved by a moving means 219 in the axial direction of the transfer drum 201 during the recording operation in synchronization with the rotation of the transfer drum 201 and located at the positions designated by 230', 231', 232', . . . In other words, the recording head 202 is caused to move in the axial direction of the transfer drum 201 each time the transfer drum 201 rotates once and by repeating this operation eight times, it forms an ink image at a pitch of 1/300 inch in a predetermined recording area 228 on the transfer drum 201. Then the recording head 202 moves to the initial position. The moving means 219 includes a cam 235 and a motor 236. With the recording head 202 so arranged as to perform the operating of forming such an ink image, it becomes only necessary to set the nozzle pitch of the recording head 202 eight times as great as the pixel pitch on the transfer drum 201 and this makes it possible to not only simplify the process of manufacturing printers of this sort but also reduce their production cost. Since ink in a low viscous state is ejected from the recording head 202, good ejection characteristics are acquired. Therefore, good quality ink images are obtainable on the transfer drum 201 with stability.

Through the aforementioned operation, an ink image is formed over the whole recording area 228.

When the formation of the ink image is terminated, the corona charger 203 irradiates negative corona ions and the charged coloring particles contained in the ink image are temporarily fixed before being separated from the solvent.

The action of temporarily fixing the charged coloring particles to the transfer drum 201 and that of separating the ink image by means of the corona charger 203 are similar to those described with reference to the first example shown in FIGS. 3 and 4.

In this example, however, the timing at which corona ions are irradiated by the corona charger 203 may be in synchronization with the formation of the ink image. In other words, the corona charger 203 may be used to irradiate corona ions uniformly after the formation of the ink image but also in synchronization with each rotation of the transfer drum 201 during the formation of the ink image. This process may particularly be effective if the ink image tends to easily flow, depending on the wetting properties of the ink on the surface of the transfer drum 201 or if the ink is difficult to wet, thus causing ink images to concentrate. More specifically, the use of the corona charger 203 for corona irradiation in synchronization with each rotation of the transfer drum 201 during the formation of the ink image is effective in temporarily fixing the charged coloring particles to the surface of the transfer drum 201 faithfully in response to the recording signal.

The means 204 for applying a solvent is then used to uniformly apply the solvent 220 forming the ink to the surface of the transfer drum 201. In this example, the pump 216 is used to supply the solvent 220 contained in the solvent container 215 to the head 218 so as to apply the solvent 220 discharged from the slit 217 to the surface of the transfer drum 201. When the solvent 220 is applied to the ink image in this case, the charged coloring particles are prevented from falling into disorder as the reflected image force acts with respect to the transfer drum 201, though the application pressure acts on the charged coloring particles. Moreover, since the thickness of the solvent 220 applied by the means 204 is regulated by the means 205 for regulating the thickness, which will be described below, the thickness of the solvent applied by the means 204 should be greater than the distance between the roller 221 for regulating the thickness thereof and the transfer drum 201.

The solvent uniformly applied by the transfer drum 201 is regulated by the roller 221 so that it has a predetermined thickness. The roller 221 is fitted with the race ring 223 at each end and when the race rings abut against the transfer drum 201, the roller is set 0.3 mm apart from the transfer drum 201 while being rotated in direction of arrow C. Consequently, the force originating from fluid viscosity is applied to the solvent 220 existing in the small gap between the transfer drum 201 and the roller 221 for regulating the thickness of a solvent so as to peel an excessive solve from the surface of the transfer drum 201. The thickness of the solvent 220 on the surface of the transfer drum 201 can thus be regulated properly. Since the reflected image force is acting on the charged coloring particles of the ink image, they will never be peeled off the surface of the transfer drum 201. In this example, the peripheral speed of the roller 221 for regulating the thickness of a solvent has been determined in the way that makes the thickness of the solvent 220 not greater than 5 μm to form a concentrated ink image on the transfer drum 201. The solvent 220 sticking to the surface of the roller 221 is removed by the peeling plate 222 and made to drop into and held in the solvent container 215.

Then the transfer drum 201 and the pressure roller 206 are caused to abut against each other to apply pressure and while the recording paper 208 is allowed to pass through the pressurized portion, the pressure thus applied is used to transfer the ink image on the transfer drum 201 to the recording paper 208. At this time, a high-quality image is obtainable on the recording paper 208 at a low pressure since the ink image keeps a suitable wetting condition.

When the transfer of the ink image to the recording paper 208 is completed, the cleaning blade 225 is made to abut against the transfer drum 201 so as to peel and remove the residual ink image off the transfer drum 201. After the passage of predetermined time, the cleaning blade 225 is released the contact condition to restore the original condition.

With the transfer type ink jet printer, it is possible to make the ink image on the transfer drum 201 a concentrated ink image by passing the former through the roller 221 for regulating the thickness of a solvent without using an evaporation means. Therefore, the printer is prevented from contamination resulting the generation of vapor of the solvent forming the ink. Since the solvent is so regulated that what has the predetermined thickness is uniformly applied after the formation of the ink image is terminated, an equally concentrated ink image may be formed. For this reason, an excellent image is obtainable with stability at a low transfer pressure without being affected by not only the time required until printing after the transfer of the image but also the printing pattern.

The same effect was obtained from the irradiation of corona ions having the polarity opposite to that of those irradiated by the corona charger upon the charged coloring particles forming the ink.

FIFTH EXAMPLE

Figure 10:
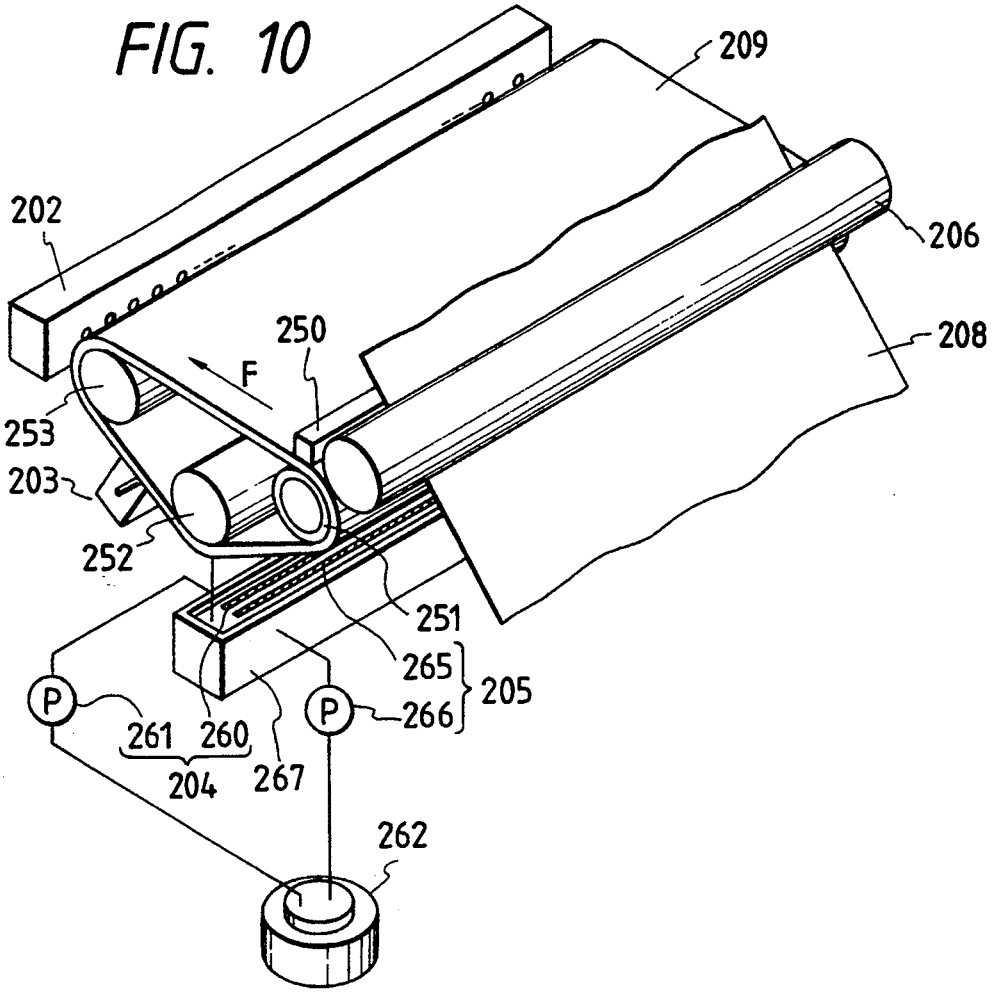
FIG. 10 is a perspective view of a fifth example.

FIG. 10 is a perspective view of a transfer type ink jet printer as a fifth example.

In this example, the printer comprises the recording head 202, the corona charger 203, the means 204 for applying a solvent, the means 205 for regulating the thickness of a solvent, the pressure roller 206, and a transfer belt cleaning pad 250, these being successively arranged around a transfer belt 209 as a transfer medium.

The transfer belt 209 is conveyed in direction of arrow F while being suspended by a conveyer mechanism including a drive roller 251, a driven roller 253 and a tension roller 252. The recording head 202, the means 204 for applying a solvent, the means 205 for regulating the thickness of a solvent, and the pressure roller 206 are arranged in the respective positions opposite to the driven roller 253, the tension roller 252 and the drive roller 251 via the transfer belt 209.

The ink used in this example contains the same solvent and charged coloring particles used in the fourth example.

The transfer belt 209 is made by piling a conductive elastic layer on a metal endless belt of such as nickel. A rubber member in the first example, for instance, may be employed as the conductive elastic layer.

The means 204 for applying a solvent and the means 205 for regulating the thickness of a solvent are partially integrally formed.

The means 204 for applying a solvent is arranged so that a solvent supply slit 260 is connected via a supply pump 261 to a solvent tank 262 containing the solvent.

Moreover, the means 205 for regulating the thickness of a solvent is arranged so that a solvent recovery slit 265 is connected via a recovery pump 266 to the solvent tank 262.

The solvent supply slit 260 and the solvent recovery slit 265 are integrally formed with a member 267, each having an opening along the axial direction of the tension roller 252.

The operation will subsequently be described.

As the operation of forming the ink image using the recording head 202 and that of irradiating corona ions using the corona charger 203 are the same as those described in the fourth example, the description of them will be omitted.

The member 267 is located opposite to the transfer belt 209 bearing the ink image with a small gap therebetween. The ink image on the transfer belt 209 is uniformly supplied with the solvent contained in the solvent tank 262 from the solvent supply slit 260 via the supply pump 261. The solvent thus uniformly applied is recovered from the solvent recovery slit 265 via the recovery pump 266 to the solvent tank 262. Since the recovery pump 266 is being operated in such a way that the portion of the solvent recovery slit 265 opposite to the transfer belt 209 is negatively pressurized in this case, not only the solvent supplied from the solvent supply slit 260 but also what is from the ink image on the transfer belt 209 may be recovered. The reflected image force referred to in the fourth example acts on the charged coloring particles forming the ink image across the transfer belt 209 and consequently the charged coloring particles will never be peeled off the surface of the transfer belt 209. As a result, an ink image with the uniformly-thick solvent applied to the charged coloring particles can be formed on the transfer belt 209 and besides a properly-concentrated ink image can be transferred to the recording paper 208 by pressing it with the pressure roller 206. The supply pump 261 and the recovery pump 266 are operated in this example so as to make 5 μm thick the solvent applied to the transfer belt 209.

Even in this example, the printer is prevented from being contaminated by the generation of vapor as no means for evaporating the solvent contained in the ink image is employed. As a uniformly concentrated ink image can be formed, a good image is obtainable with stability under the low transfer pressure, irrespective of the time required for printing up to transfer, without being affected by the printing pattern.

SIXTH EXAMPLE

Figure 11:
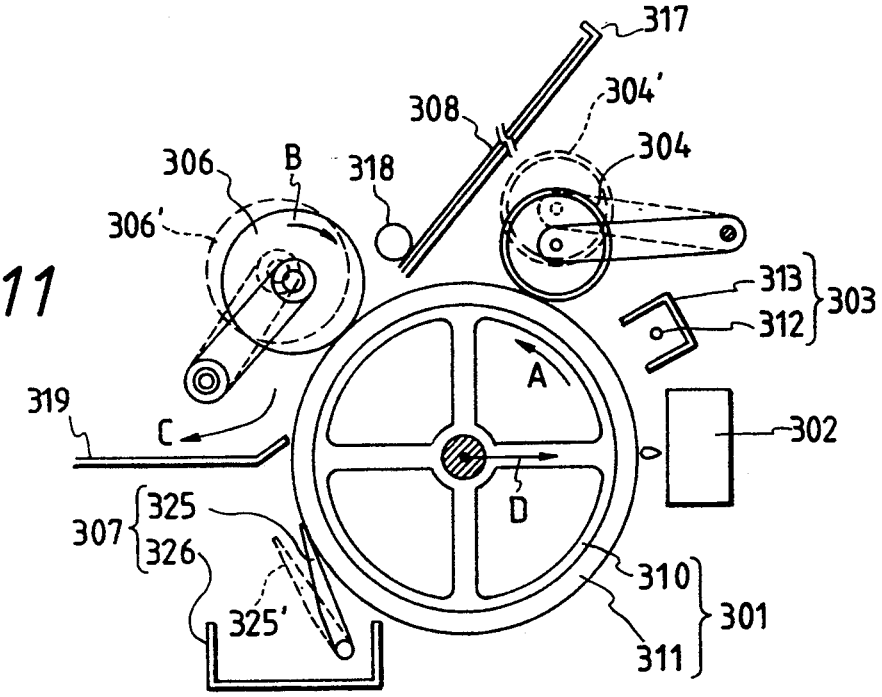
FIG. 11 is a side view of a sixth example.

FIG. 11 is a side view of the principal part of a transfer type ink jet printer as a sixth example.

In this example, the printer comprises a recording head 302, a corona charger 303, a means 304 for removing a solvent, this means being a poly 4-ethylene fluoride mesh roller as a material for sucking and absorbing the solvent, a pressure roller 306, and a transfer drum cleaning device 307, these being successively arranged around a transfer drum 301 as a transfer medium.

The transfer drum 301, the recording head 302, the corona charger 303 and the pressure roller 306 are arranged similarly as those in the fourth example (FIG. 7).

The means 304 for removing a solvent is a poly 4-ethylene fluoride mesh roller having uniform spaces 0.1 μm in diameter, which is also sufficiently smaller than the size of charged coloring particles dispersed in ink as will be described later. The means 304 for removing a solvent is rotatably supported so that it is driven while abutting against the transfer drum 301.

Recording paper 308 is conveyed from a stacker 317 via a separating roller 318 in direction of C of FIG. 11 and stored on a tray 319.

The transfer drum cleaning device 307 includes a cleaning blade 325 of urethan rubber and a housing 326. The cleaning blade 325 is connected to a drive means (not shown), it edge being so arranged that it can abut against the surface of the transfer drum 301 and can also be released therefrom.

Ink for use contains a solvent and charged coloring particles similar to those in the fourth example.

The size of, charged coloring particles for use in this example ranges from 0.2 to 2 μm and larger than 0.1 μm as the size of poly 4-ethylene fluoride meshes forming the aforementioned means 304 for removing a solvent.

The operation will subsequently be described.

In the initial state where no recording signal is input, the means 304 for removing a solvent, the pressure roller 306 and the cleaning blade 325 of the transfer drum cleaning device 307 are so held as to be pressed against or released from the transfer drum 201. Solid lines designate a state in which the means 304 for removing a solvent, the pressure roller 306 and the cleaning blade 325 are pressed against or kept in contact with the transfer drum 301, whereas broken lines 304', 306', 325' indicate that they are released therefrom; in the initial state, they are held in position as indicated by the broken lines.

When the recording signal is input to the recording head 302 in that state, an ink image is formed on the outer peripheral surface of the transfer drum 301. Like the aforementioned recording head 202 in the fourth example (FIG. 7), the cam (235) and the motor (236) are used to perform the operation of forming the ink image by means of the recording head 302.

When the formation of the ink image is terminated, the corona charger 303 irradiates corona ions negatively polarized as in the case of charged coloring particles in the ink and the charged coloring particles contained in the ink image are temporarily fixed before being separated from the solvent. As the operation of temporarily fixing the ink image and that of separating the solvent are the same as those described in the other examples, the description of them will be omitted.

In this example, the timing at which corona ions are irradiated by the corona charger 303 is synchronized with the formation of the ink image. In other words, the corona charger 303 is used to irradiate corona ions in synchronization with each rotation of the transfer drum 301 during the formation of the ink image.

Subsequently, the means 304 for removing a solvent is pressed against the transfer drum 301 so as to suck and remove the solvent thus separated from the transfer drum 301. Since the adhering force of the charged coloring particles is acting with the surface of the transfer drum 301, they will never be peeled off the surface of the means 304. As the solvent is instantly adsorbed when poly 4-ethylene fluoride meshes as the means 304 for removing a solvent come into contact with it, the ink image on the transfer drum 301 is concentrated and becomes fit for transfer.

Then the transfer drum 301 and the pressure roller 2 306 are caused to abut against each other to apply pressure and while the recording paper 308 is allowed to pass through the pressurized portion, the pressure thus applied is used to transfer the ink image on the transfer drum 301 to the recording paper 308. At this time, a high-quality image is obtainable on the recording paper 308.

When the transfer of the ink image to the recording paper 308 is terminated, the cleaning blade 325 is made to abut against the transfer drum 301 so as to peel and remove the residual ink image off the surface of the transfer drum 301. After the passage of predetermined time, the cleaning blade 325 is released the contact condition to restore the original condition.

In this example, the means 304 for removing a solvent, which is a poly 4-ethylene fluoride mesh roller as the material for sucking and absorbing the solvent, makes it possible to form a concentrated ink image on the transfer drum 301 without using an evaporation means. Moreover, the inside and outside of the printer can be prevented from being contaminated by the generation of vapor of the solvent contained in the ink. Although poly 4-ethylene fluoride meshes have been employed as the means for removing a solve in this example, similar effect may be achieved by using silicone rubber or the like as a material for sucking and absorbing the solvent. With respect to the timing at which the irradiation of corona ions and solvent removal using the means 304 are effected in this example, these process steps may be taken collectively after the operation of forming the ink image is terminated.

The present invention is applicable to not only the conductive material as a transfer medium but also what has a surface layer coated with an insulating material. This is also the case with any other example of the present invention.

SEVENTH EXAMPLE

Figure 12:
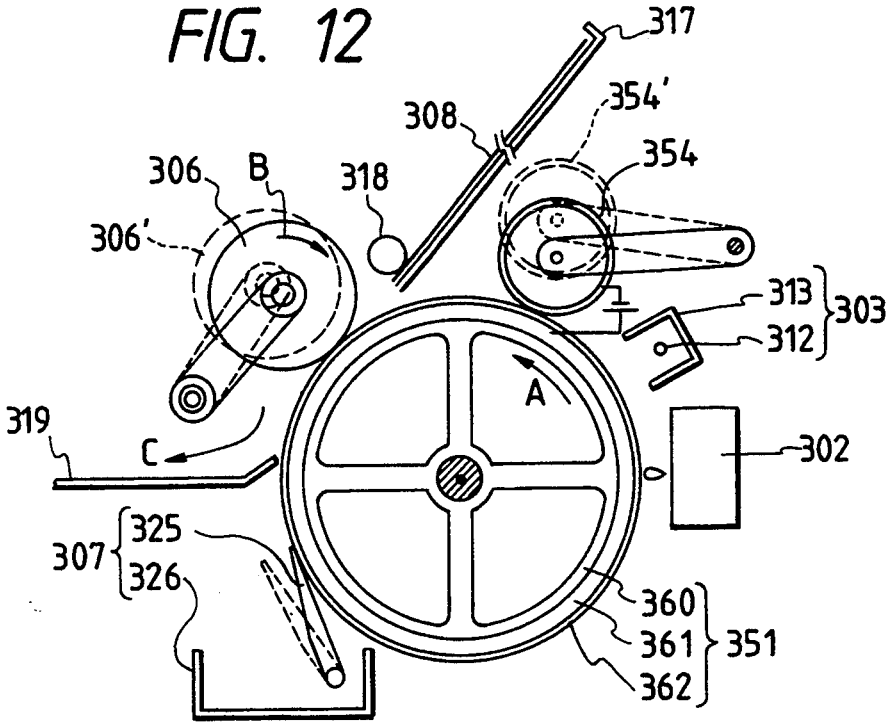
FIG. 12 is a side view of a seventh example.

FIG. 12 is a side view of the principal part of a transfer type ink jet printer as a seventh example.

In this example, the printer comprises the recording head 302, the corona charger 303 as a means for temporarily fixing charged coloring particles in an ink image, a means 354 for removing a solvent, this means being a metal mesh roller, the pressure roller 306 as a transfer means, and the transfer drum cleaning device 307, these being successively arranged around a transfer drum 351 as a transfer medium.

As the recording head 302, the corona charger 303, the pressure roller 306 and the transfer drum cleaning device 307 are similar to those in the sixth example, the detailed description of them will be omitted.

Ink contains the solvent and the charged coloring particles in the fourth example, the charged coloring particles being negatively charged.

The transfer drum 351 is provided with a conductive elastic layer 361 around a metal pipe 360 and further an insulating fluorine coating 362 on the surface layer. A voltage of 500 V is applied between the means 354 for removing a solvent and the conductive elastic layer 361. The conductive elastic layer 361 is positively polarized contrary to the charged coloring particles. The means 354 for removing a solvent is a metal mesh roller which is 4 mm thick and has spaces 20 μm in diameter. In this case, the method of applying voltage between the transfer drum 351 and the means 354 is not limited to what has been stated above. Instead, the voltage polarized opposite to the charged coloring particles may be applied to the transfer drum 351 or what is polarized identically with the charged coloring particles may otherwise be applied to the means 354.

As the operation is similar to that in the sixth example, the description thereof will be omitted.

In this example, a concentrated ink image can be formed on the surface of the transfer drum 351 without using an evaporation means since the means 354 for removing a solvent in the form of a metal mesh roller. Since the metal meshes to which the voltage has been applied is used, the solvent is absorbed while the electrostatic force for fixing the charged coloring particles onto the surface of the transfer drum is utilized. For the reason stated above, the diameter of the space in the metal meshes as the means 354 for removing a solvent may be greater than the size of the charged coloring particles as well. Consequently, the capillary force acting on the absorption of the solvent can be adjusted when the metal mesh size is set. The concentration of ink can thus be controlled to make the ink image fit for transfer.

EIGHTH EXAMPLE

Figure 13:
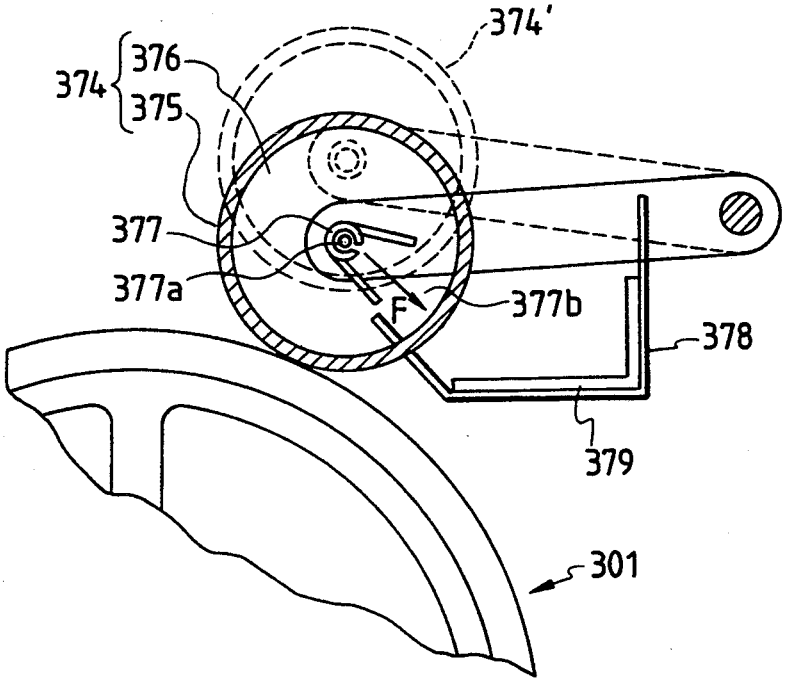
FIG. 13 is a side view of an eighth example.
Figure 14:
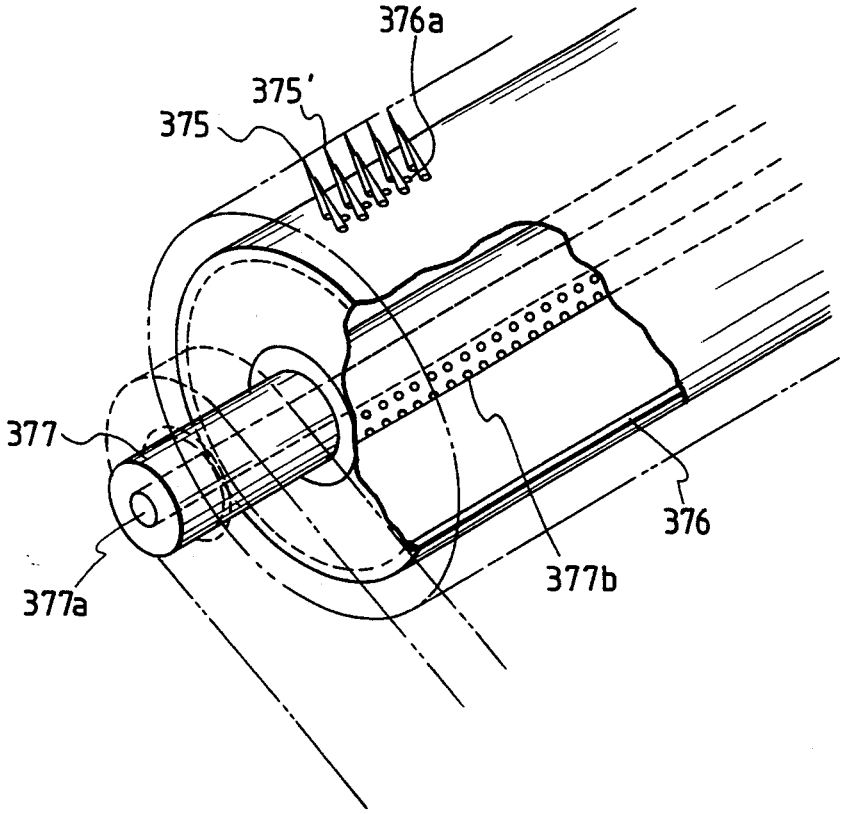
FIG. 14 is a partial expanded perspective view of the eighth example.

FIG. 13 is a side view of a means for removing a solve in a transfer type ink jet printer as an eighth example and FIG. 14 is an enlarged perspective view thereof.

As the total arrangement of this example is similar to that of the sixth example, the description thereof will be omitted.

In FIGS. 13, 14, a means 374 for removing a solvent is provided with a number of metal pins 375 offering excellent wetting properties with respect to the solvent and a support 376 for supporting the pins 375. The pin-to-pin 375, 375' space is set at 30 μm. In FIG. 14, though some of the pins 375 are locally illustrated, these pins are provided over the whole surface of the support 376. The support 376 is provided with a number of small holes **376*a* in addition to a pin-supporting portion. Ball bearings are used to couple the support 376 to a support shaft 377 so that the support is made rotatable. The support shaft 377 is solid with an air flow passage formed inside. Air is sent by a compressor or the like from an inlet 377*a* of the support shaft 377 and led out from air outlets 377*b* in direction of F of FIG. 14. A solvent recovery container 378 is installed close to the means 374 for removing a solvent and supplied with a solvent-absorbent material 379** on the bottom and the side of it.

The operation of removing the solvent will subsequently be described.

As in the case of the sixth example (FIG. 11), the means 374 for removing a solvent is made to abut against the solvent separated on the transfer drum 301. When the spins 375 contact the solvent, the capillary force between the adjacent pins 375, 375' and the wetting of the pin 375 itself the solvent is instantly removed. As the size of the ink image is minimum 120 μm in diameter and the pin-to-pin space is 30 μm, the solvent is removed without fail. After the solvent is removed by the means 374 for removing a solvent, compressed air is blown out of the air outlets **377*b* to blow off the solvent sticking to the pins 375, whereby it is recovered into the solvent recovery container 378**.

In this example, a concentrated ink image can be formed by the means 374 for removing a solvent on the surface of the transfer drum 301 without using an evaporation means. The ink image is also prevented from being badly affected by the solvent vapor.

NINTH EXAMPLE

Figure 15:
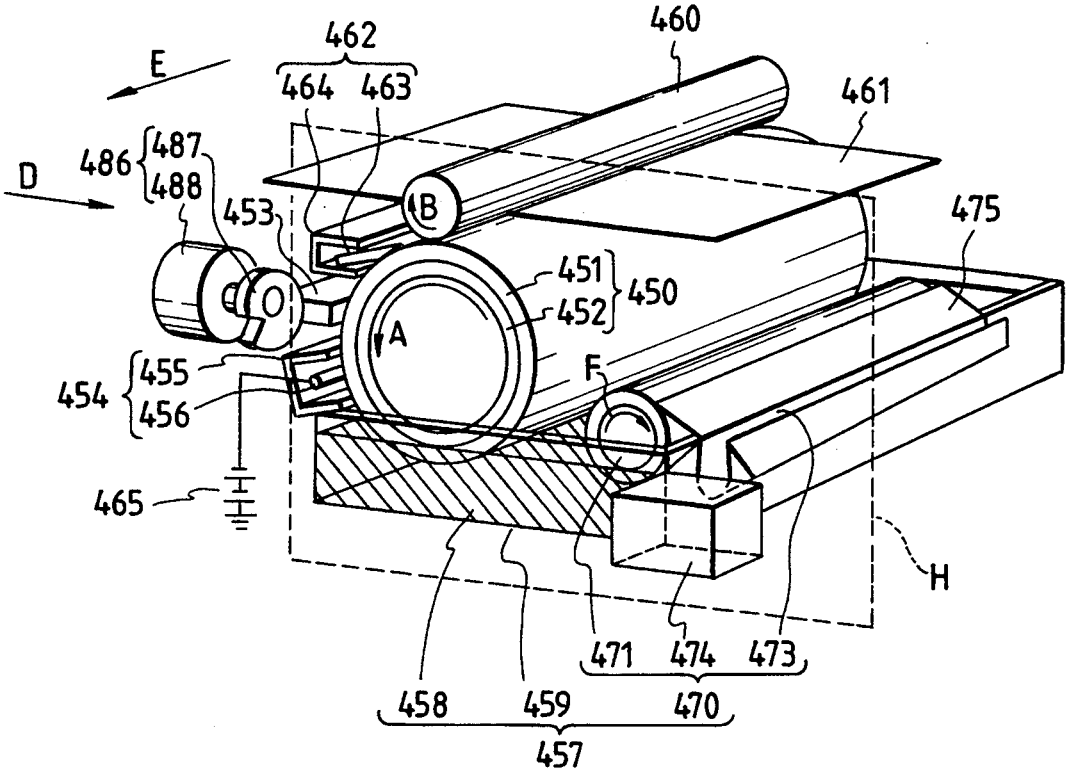
FIG. 15 is a perspective view of a ninth example.

FIG. 15 is a perspective view of a transfer type ink jet printer as a ninth example.

Figure 16:
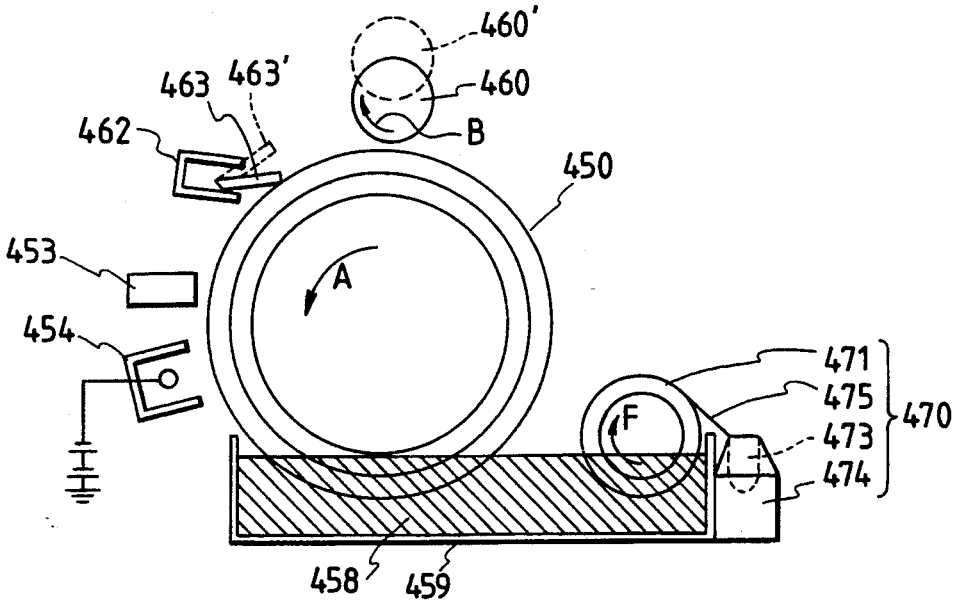
FIG. 16 is a sectional view on an imaginary plane H of FIG. 15.

FIG. 16 is a sectional view taken on an imaginary plane H of FIG. 15.

In this example, the printer comprises a recording head 453, a corona charger 454 as a means for temporarily fixing charged coloring particles in an ink image, a means 457 for removing a solvent, this means being equipped with a solvent recovery device 470 using a surface active aqueous liquid agent, a pressure roller 460, and a transfer drum cleaning device 462, these being successively arranged around a transfer drum 450 as a transfer medium.

The transfer drum 450 is similarly arranged as what has been described in the fourth example (FIG. 7), including a conductive elastic layer 451 around a metal pipe 452. The transfer drum 450 is rotatable in direction of arrow A via a fixed gap with respect to the recording head 453.

The recording head 453 and the corona charger 454 are similar to those referred to in the fourth example (FIG. 7). Numeral 456 denotes a tungsten wire, 455 a housing, and 465 a high-tension voltage supply.

A means 457 for removing a solvent using such a surface active aqueous liquid agent include a container 459 for containing the surface active aqueous liquid agent 458, part of the transfer drum 450 being allowed to pass through the surface active agent 458. In this example, 1% aqueous liquid of α-olefin sulfonate was used as the surface active aqueous liquid agent 458. In this case, the surface active aqueous liquid agent 458 is not limited to this sort but use can be made of acyl peptide, alkyl benzine sulfonate, N-acyl methyl taurine or the like in a single substance or in combination to provide a 0.1 to 10% surface active aqueous liquid agent or to provide a single liquid substance.

The solvent recovery device 470 provided for the means 457 for removing a solvent is such that an aluminum solvent adsorbent roller 471 is rotatably support in direction of F of FIG. 15 and that part of the adsorbent roller 471 passes through the aqueous surface active aqueous liquid agent. A solvent recovery groove 473 and a blade 475 having a solvent recovery container 474 are made to abut against the solvent adsorbent roller 471. The solvent adsorbent roller 471 may be made of not only aluminum but also a lyosolvent material. In addition, use can be made of material discharging a solvent that has once been adsorbed when an external force is applied thereto from the outside, the material being such as urethan foam, polypropylene fiber, polystyrene fiber and the like having high voids but, though having high adsorbent properties with respect to the solvent, offering poor solvent retaining force. Moreover, use may also be made of active carbon having absorbent action on the solvent.

The pressure roller 460 is similar to what has been referred to in the fourth example and rotates at the same peripheral speed as that of the transfer drum 450 in direction of arrow B via recording paper 461 as a recording medium while it is pressed thereagainst.

The transfer drum cleaning device 462 includes a cleaning blade 463 of urethan rubber and a housing 464. The cleaning blade 463 is connected to a drive means (not shown) and it edge being so arranged that it can abut against the surface of the transfer drum 450 and can also be released therefrom.

Ink for use contains a solvent and charged coloring particles similar to those in the fourth example.

The operation will subsequently be described.

In the initial state where no recording signal is input, like in the fourth.example, solid lines designate the pressure roller 460 and the cleaning blade 463 are pressed against or kept in contact with the transfer drum 450, whereas broken lines 460', 463' indicate that they are released therefrom; in the initial state, they are held in position as indicated by the broken lines.

When the recording signal is input to the recording head 453 in that state, an ink image is formed on the outer peripheral surface of the transfer drum 450. Like the aforementioned recording head in the fourth example (FIG. 7), the same will be applied to the recording head 453 in this case where the ink image is formed thereby.

While the ink image is being formed, negatively polarized corona ions identical in polarity with the charged coloring particles in the ink are irradiated by the corona charger in synchronization with the recording of the ink image. The charged coloring particles in the ink image are temporarily fixed onto the transfer drum 450 before being separated from the solvent. In this example, the timing at which corona ions are irradiated by the corona charger 454 is synchronized with the formation of the ink image. In other words, the corona charger 454 is used to irradiate corona ions in synchronization with each rotation of the transfer drum 450 during the formation of the ink image.

Figure 17:
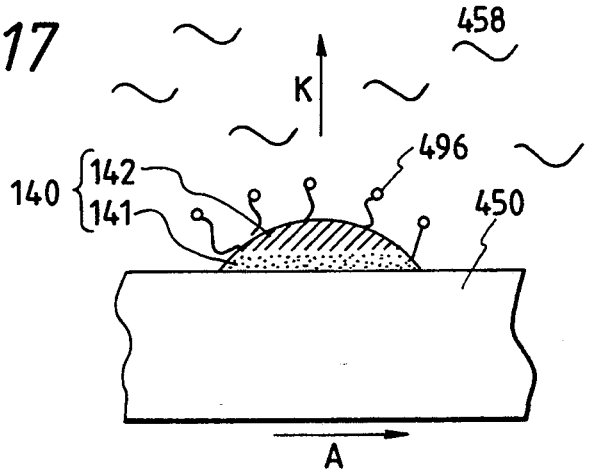
FIG. 17 is a diagram illustrating an ink image condition within an aqueous surface-active agent explanatory of the solvent-removing means in the ninth example.
Figure 18:
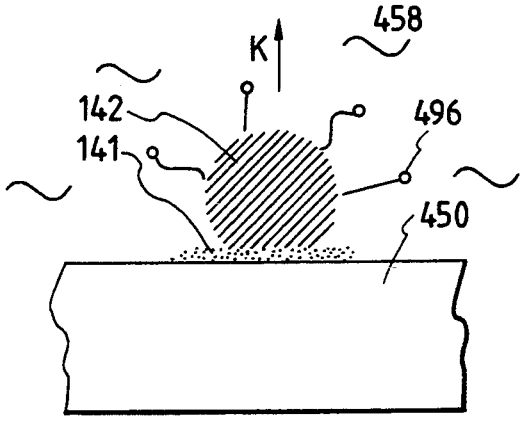
FIG. 18 is a diagram illustrating an ink image condition within an aqueous surface-active explanatory of the solvent-removing means in the ninth example.

Subsequently, the solvent thus separated is removed by the means 457 for removing a solvent by causing it to contact the surface active aqueous liquid agent. Referring to FIGS. 16, 17 and 18, the operation of removing the solvent by the means 457 for removing a solvent using the surface active aqueous liquid agent 458 will be described. FIGS. 17, 18 illustrate the state of the ink image 140 in the surface active aqueous liquid agent 458. As shown in FIG. 16, the surface active aqueous liquid agent 458 is contained in the container 459 and part of the transfer drum 450 is arranged so that it rotates within the surface active aqueous liquid agent 458 in direction of arrow A. As shown in FIG. 17, moreover, the centrifugal force acts on the ink image 140 on the surface of the transfer drum 450 in direction of arrow K as the transfer drum rotates in the surface active aqueous liquid agent 458 in direction of arrow K. Since molecules 496 of a surface active agent are formed of those hydrophilic and hydrophobic, those hydrophobic directionally stand in line on the interface of the solvent 142 and are readily absorbable, this results in acting as what greatly reduces the adhesive force of the interface between the solvent 142 and the transfer drum 450. The ink image 140 irradiated with the corona ions undergoes the separation of the charged coloring particles 141 from the solvent 142 causes the solvent 142 to secede from the surface of the transfer drum 450 into the surface active aqueous liquid agent 458 as it rolls up as shown in FIG. 18 due to the centrifugal force as wells as the action of the surface active agent. As the charged coloring particles 141 stick to the surface of the transfer drum 450 as stated above and are temporarily fixed thereto at this time, they will never be peeled off by the force originating from the fluid viscosity and the centrifugal force received when they passes through the surface active aqueous liquid agent 458. When the transfer drum 450 is freed from the surface active aqueous liquid agent 458, the ink image 140 on the surface of the transfer drum 450 becomes what bears concentrated charged coloring particles.

Even when a single aqueous substance is employed as the surface active aqueous liquid agent 458, the action of removing the solvent is effected by the centrifugal force as the transfer drum 450 rotates. However, the rolling-up of the solvent 142 in the surface active aqueous liquid agent 458 is more effectively implemented in a case where a surface active aqueous liquid agent other than the aqueous substance is used because, in addition to the centrifugal force, the voluntary rolling-up of the solvent 142 is effected. When the surface active aqueous liquid agent is used, moreover, surface agent molecules 496 are adsorbed into the surface of the solvent 142 remaining in the surface active aqueous liquid agent 458 to let the colloidal protective action work, which is further effective for the purpose as the solvent 142 is hardly allowed to stick to the transfer drum 450 again.

The solvent 142 within the surface active aqueous liquid agent 458 is recovered by the solvent recovery device 470. Referring to FIG. 15, a mechanism of recovering the solvent will be described. Since the solvent-adsorbent roller 471 is lyophilic, it selectively adsorbs the solvent in the surface active aqueous liquid agent 458 when it passes through the surface active aqueous liquid agent 458. The solvent adsorbed into the solvent-adsorbent roller 471 is scraped by the blade 475 in contact with the solventadsorbent roller 471 into the solvent recovery groove 473. As the bottom of the solvent recovery groove 473 is inclined toward the solvent recovery container 474 attached to the side of the solvent recovery groove 473, the solvent 142 thus scraped into the solvent recovery groove 473 is recovered into the solvent recovery container 474.

The number of revolutions of the solvent-adsorbent roller 471 should .be set in conformity with the material used for the solvent-adSorbent roller 471, that is, the wetting properties of the material used for the solvent-adsorbent roller 471 with respect to the surface active aqueous liquid agent 458. With a material easier to wet, the surface active aqueous liquid agent 458 together with the solvent 142 may be adsorbed into the solvent-adsorbent roller 471 unless it is rotated at low speed. Therefore, the solvent-adsorbent roller 471 should preferably be made of a material which is hard to wet with water, whereas the solvent-adsorbent roller 471 should preferably the operated at possible low speed.

Then the transfer drum 450 and the pressure roller 460 are made to abut against each other to apply pressure and the recording paper 461 as a recording medium is passed through the pressurized portion so as to transfer the ink image on the surface of the transfer drum 450 to the recording paper 461 under the pressure. A good quality image is then obtainable on the recording paper 461.

When the ink image is completely transferred to the recording paper 461, the cleaning blade 463 abuts against the transfer drum 450 and the residual in image on the surface of the transfer drum 450 is peeled off and removed. With the passage of predetermined time, the cleaning blade 463 is released from contacting the transfer drum and restores the original condition.

In this example, a concentrated ink image can be formed by the means 457 for removing a solvent on the surface of the transfer drum 450 using the surface active aqueous liquid agent 458 without using an evaporation means. As the means 457 for removing a solvent is equipped with the solvent recovery device 470, the solvent 142 is prevented from sticking to the surface of the transfer drum 450. The inside and outside of the printer are also prevented from being contaminated by the generation of vapor of the solvent forming the ink.

TENTH EXAMPLE

Figure 19:
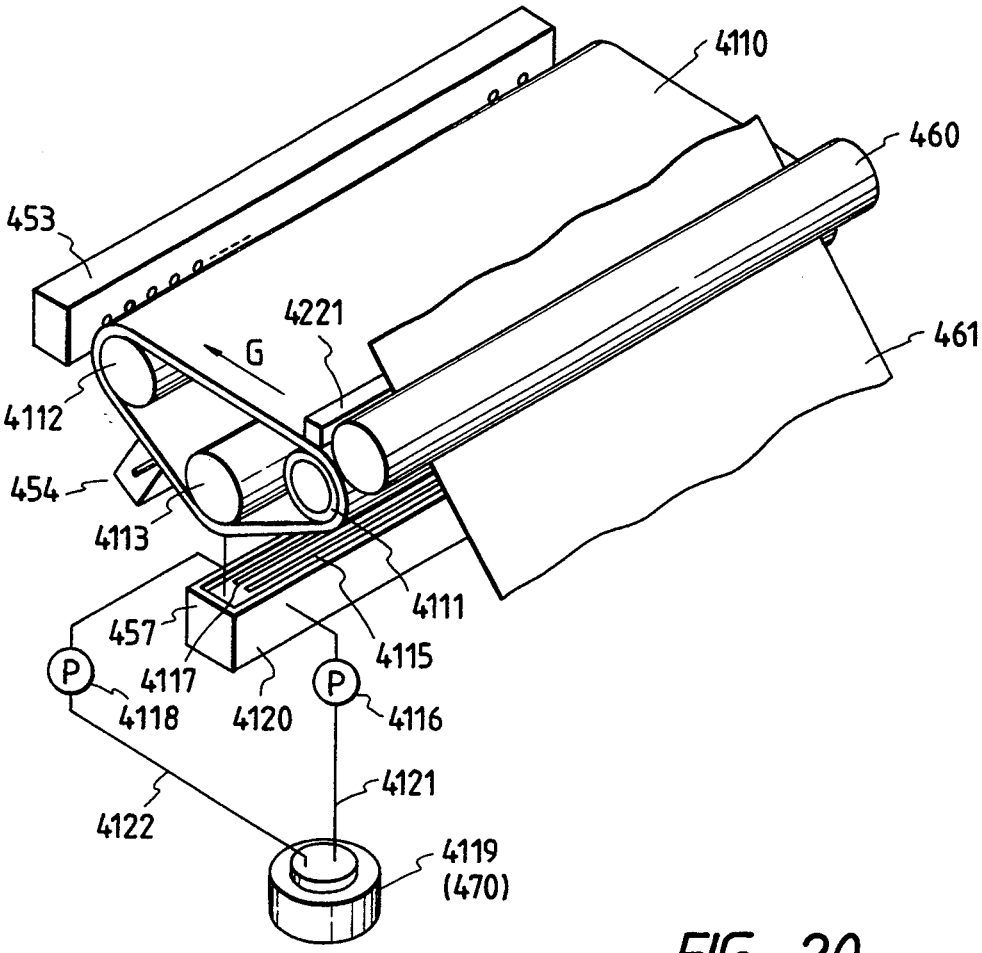
FIG. 19 is a perspective view of a tenth example.

FIG. 19 is a perspective view of a transfer type ink jet printer as a tenth example.

In this example, the printer comprises the recording head 453, the corona charger 454 as a means for temporarily fixing charged coloring particles in an ink image, the means 457 for removing a solvent, this means being equipped with the solvent recovery device 470 using the surface active aqueous liquid agent 458, the pressure roller 460, and a transfer belt cleaning pad 4221, these being successively arranged around a transfer belt 4110 as a transfer medium.

The transfer belt 4110 is mounted on a conveying mechanism having a drive roller 4111, a driven roller 4112 and a tension roller 4113 and moved in direction of arrow G of FIG. 19.

Ink for used in this example contains the solvent and the charged coloring particles used in the ninth example.

The transfer belt 4110 is similar in construction to what has been referred to as 209 in the fifth example (FIG. 10).

The means 457 for removing a solvent having the solvent recovery device 470 and using the surface active aqueous liquid agent 458 is such that a supply slit 4117 is connected via a supply pump 4118 to a surface active aqueous liquid agent tank 4119 for containing the surface active aqueous liquid agent 458.

Moreover, a recovery slit 4115 is connected via a recovery pump 4116 to the surface active aqueous liquid agent tank 4119. The supply and recovery slits are integrally formed with a member 4120 and the respective openings are arranged in the axial direction of the tension roller 4113. The solvent recover device 470 is also situated in the surface active aqueous liquid agent tank 4119.

The operation will subsequently be described.

As the operation of forming the ink image using the recording head 453 and that of irradiating corona ions using the corona charger 454 to temporarily fix the ink image and to separate the charged coloring particles from the solvent are the same as those described in the ninth example, the description of them will be omitted.

The member 4120 is located opposite to the transfer belt 4110 bearing the ink image with a small gap therebetween. The surface active aqueous liquid agent 458 supplied from the liquid tank 4119 via the supply pump 4118 is uniformly applied through the supply slit 4117 to the ink image on the transfer belt 4110. The surface active aqueous liquid agent 458 thus uniformly applied is recovered from the recovery slit 4115 via the recovery pump 4116 into the surface active aqueous liquid agent tank 4119. In this case, the recovery slit 4115 is arranged so as to operate the recovery pump 4116 to avoid the presence of negative pressure in a portion opposite to the transfer belt 4110. It is therefore possible to recover the solvent from the ink image on the surface of the transfer belt 4110, together with the surface active aqueous liquid agent 458 supplied from the supply slit 4117. In this case, the charged coloring particles forming the ink image will never be peeled off the surface of the transfer belt 4110 as an adhesive force as strong as what has been described in the ninth example is acting with the transfer belt 4110. As a result, a concentrated ink image can be formed on the surface of the transfer belt 4110 and a properly concentrated ink image can also be transferred to the recording paper 461 by means of the pressure roller 460.

As the solvent recovery device 470 is arranged in the surface active aqueous liquid agent tank 4119 and used to remove the solvent from surface active aqueous liquid agent 458 recovered from the recovery slit 4115 via the recovery pump 4116 and to supply only the surface active aqueous liquid agent 458 via the supply pump 4118 to the supply slit 4117.

Figure 20:
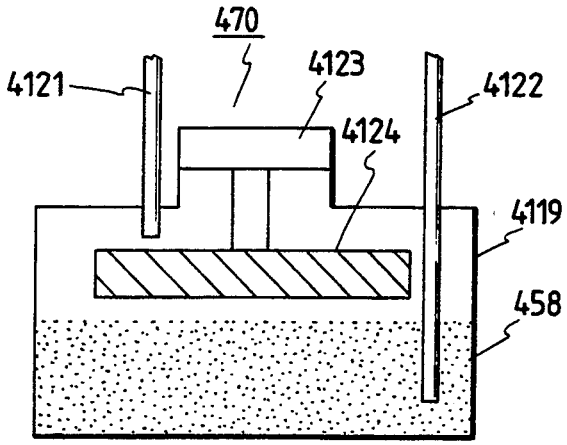
FIG. 20 is a sectional view of a solvent-recovering device in the tenth example.

FIG. 20 is a sectional view of the surface active aqueous liquid agent tank 4119. The surface active aqueous liquid agent 458 recovered through the recovery pump 4116 is made to flow from an inlet pipe 4121 via urethane foam as a solvent-adsorbent material 4124 into the surface active aqueous liquid agent tank 4119. At this time, the solvent contained in the surface active aqueous liquid agent 458 is adsorbed into the solvent adsorbent material. The solvent-adsorbent material 4124 is made rotatable by a motor 4123 and the solvent is uniformly adsorbed into one side of the solvent-adsorbent material 4124. The solvent-adsorbent material 4124 may be driven by not only a motor but also drive-force transmitting means annularly arranged. An outlet pipe 4122 is used to suck only the surface active aqueous liquid agent 458 and supply it via the supply pump 4118 to the supply slit 4117.

Although the single aqueous substance may be used to remove the solvent even in this example, it is more effective to employ the surface active aqueous liquid agent 458 as in the case of the ninth example. With respect to the timing at which the irradiation of corona ions and solvent removal using the means 457 for removing a solvent are effected, these process steps may be taken collectively after the operation of forming the ink image is terminated. More specifically, while the corona charger 454 is used for corona irradiation in synchronization with each rotation of the transfer belt 4110 during the formation of the ink image, the means 457 for removing a solvent is employed to remove the solvent. In addition, while corona ions are collectively irradiated after the formation of the ink image is terminated, the means 457 for removing a solvent may be used to remove the solvent in this example.

In this example, the means 457 for removing a solvent using the surface active aqueous liquid agent 458 makes it possible to form a concentrated ink image on the transfer belt 4110 without using the means for evaporating the solvent contained in the ink image. Since the means 457 for removing a solvent is equipped with the solvent recovery device 470, the solvent is prevented from sticking to the surface of the transfer belt 4110 again. Moreover, the inside and outside of the printer can be prevented from being contaminated by the generation of vapor of the solvent contained in the ink.

Although both the charged coloring particles in the ink and the corona ions to be irradiated are negatively polarized in the ninth and tenth examples, similar effect is achievable even when both of them are positively polarized.

In the first through tenth examples stated above, the corona ions thus irradiated and the charged coloring particles contained in the ink are polarized opposite to each other to ensure similar effect; however, both of them should preferably be polarized identically for the following reason.

Figure 21:
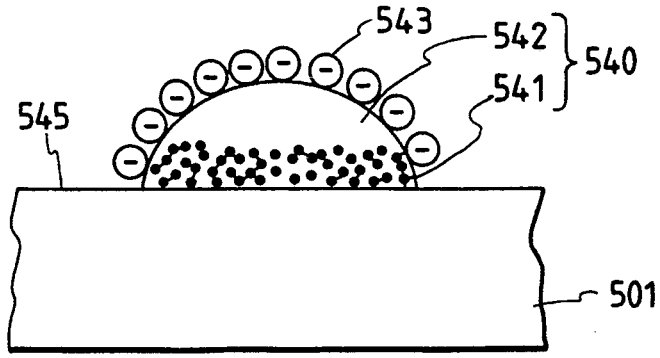
FIG. 21 is a diagram illustrating a state in which an ink image on a transfer medium is concentrated after the ink image is irradiated with a small amount of negatively-polarized corona ions having the same polarity as that of charged coloring particles in the ink.
Figure 22:
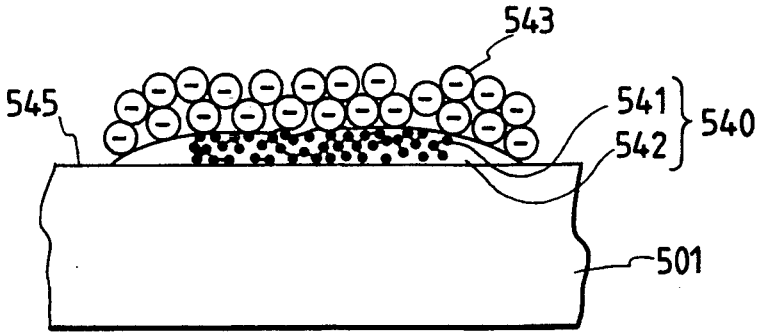
FIG. 22 is a diagram illustrating a state in which an ink image on the transfer medium is concentrated after the ink image is irradiated with a large amount of negatively-polarized corona ions having the same polarity as that of charged coloring particles in the ink.
Figure 23:
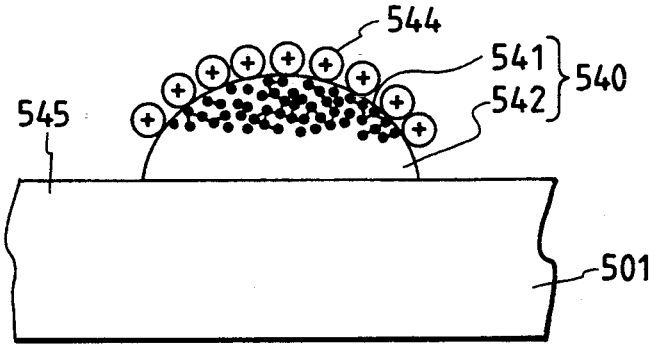
FIG. 23 is a diagram illustrating the state of an ink image on the transfer medium after the ink image is irradiated with a small amount of positively-polarized corona ions having the polarity opposite to that of charged coloring particles in the ink.
Figure 24:
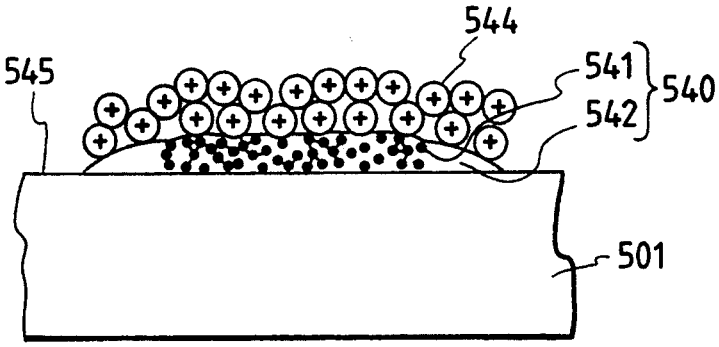
FIG. 24 is a diagram illustrating the state of an ink image on the transfer medium after the ink image is irradiated with a large amount of positively-polarized corona ions having the polarity opposite to that of charged coloring particles in the ink.
Figure 25:
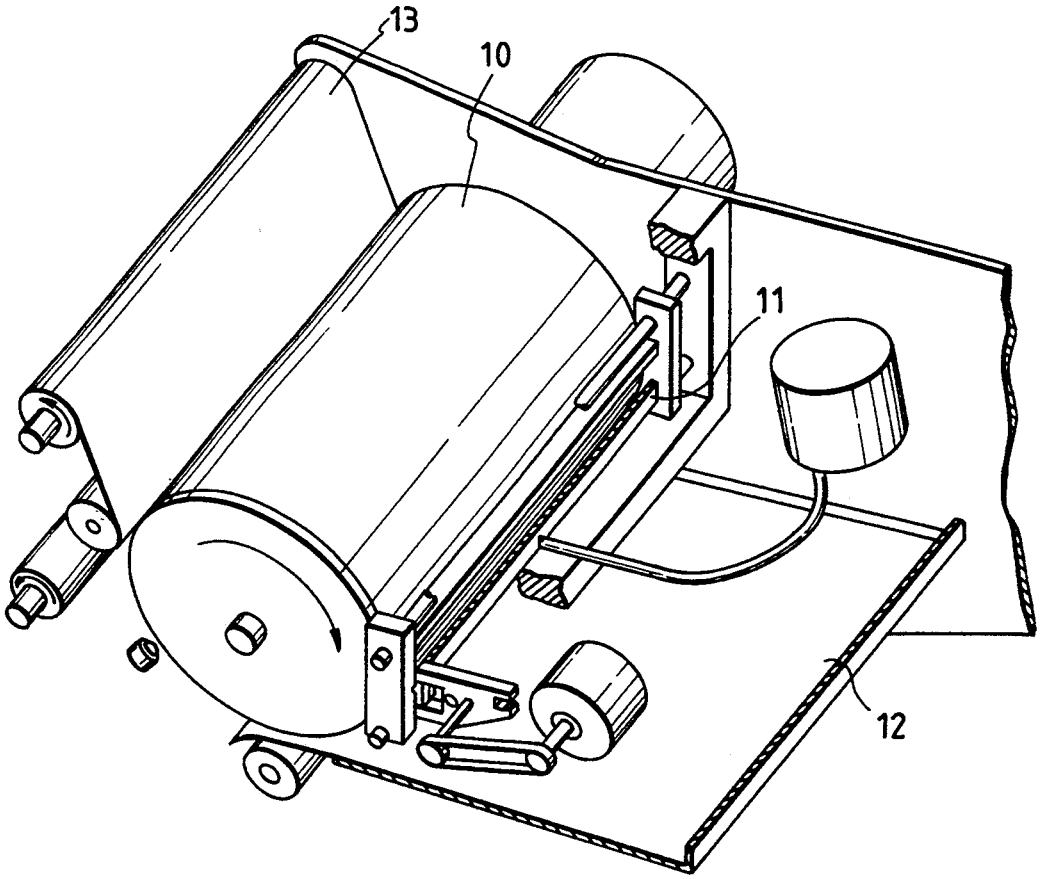
FIG. 25 PRIOR ART
FIG. 25 is a diagram illustrating a first example of a conventional transfer type ink jet printer.
Figure 26:
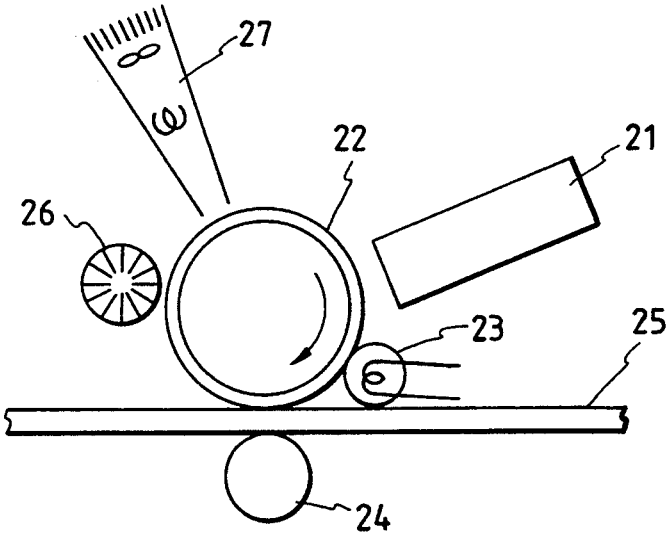
FIG. 26 PRIOR ART
FIG. 26 is a diagram illustrating a second example of a conventional transfer type ink jet printer.
Figure 27:
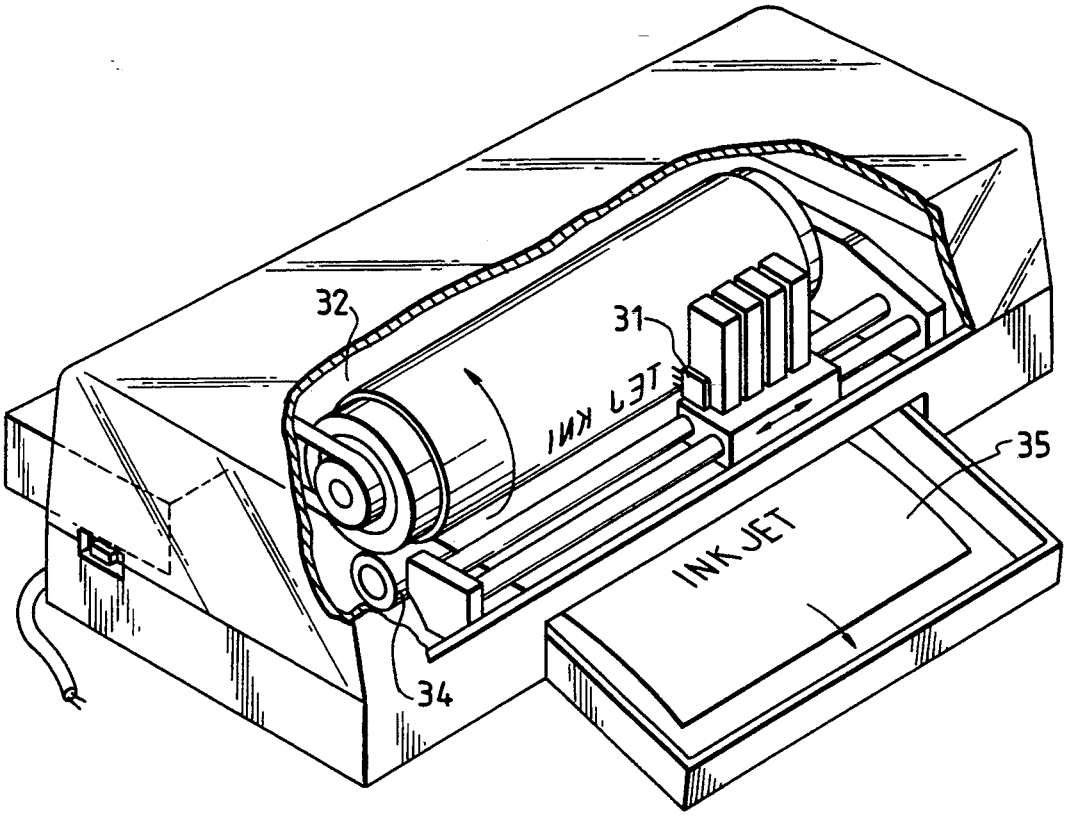
FIG. 27 PRIOR ART
FIG. 27 is a diagram illustrating a third example of a conventional transfer type ink jet printer.

FIGS. 21 and 22 illustrate the conditions of the ink image on the transfer medium when the corona ions polarized negatively as the charged coloring particles in the ink are irradiated. In comparison, FIGS. 23, 24 illustrate the conditions of the ink image on the transfer medium when the corona ions polarized positively, that is, those polarized opposite to the charged coloring particles in the ink are irradiated. In these cases, charged coloring particles 541 are negatively charged, whereas a transfer medium 501 is grounded.

When a small amount of corona ions polarized identically with the charged coloring particles 541 in the ink, that is, those polarized negatively are irradiated by a corona charger 543, the charged coloring particles 541 dispersed in an ink image 540 are concentrated and separated from a solvent 542 as previously noted.

When a large amount of corona ions polarized identically with the charged coloring particles 541 in the ink are irradiated by the corona charger 543, the surface of the ink image 540 is negatively charged as shown in FIG. 22 and the charged coloring particles 541 stick to the surface of the transfer medium 501 as they are affected by the electrostatic force. At this time, there is produced the force of causing the solvent 542 on the surface of the ink image 540 negatively charged by that large amount of negatively-polarized corona ions 543 to move toward the surface of the transfer medium 501 and the shape of droplets of the solvent 542 on the surface of the ink image 540 changes to decrease in the direction of height of the ink image 540 and tends to expand in comparison with the contact area between the ink image 540 and the transfer medium 501. On the contrary, the charged coloring particles 541 keep intact the contact area between the ink image and the transfer medium 501 before ion irradiation, so that a concentrated ink image results in growing near the transfer medium 501.

Consequently, there is formed a stable ink image without being affected by the mount of negatively-polarized corona ions 543 when the corona charger is used to irradiate the corona ions polarized identically with the charged coloring particles 541 in the ink.

When a small amount of corona ions 544 polarized opposite to the charged coloring particles 541 in the ink are irradiated by the corona charger, the surface of the ink image 540 is positively charged as shown in FIG. 23 and the charged coloring particles 541, which are affected by the electrostatic force, move close to the surface of the ink image 540, thus failing to stick to the transfer medium 501.

When, moreover, a large amount of inversely-polarized corona ions 544 are irradiated thereby, the surface of the ink image 540 is positively charged as shown in FIG. 24 and though the charged coloring particles 541 tries to move close to the surface of the ink image 540 because of the electrostatic force, there is produced the force of causing the solvent 542 on the surface of the ink image 540 positively charged by that large amount of positively-polarized corona ions 544 to move toward the surface of the transfer medium 501 and the shape of droplets of the solvent 542 on the surface of the ink image 540 changes to decrease in the direction of height of the ink image 540 and tends to expand in comparison with the contact area between the ink image 540 and the transfer medium 501. However, the charged coloring particles 541 keep intact the contact area between the ink image 540 and the transfer medium 501 before ion irradiation, thus succeeding in forming a concentrated ink image near the transfer medium 501.

Notwithstanding, the concentration of the ink is poor in comparison with a case where the identically-polarized ions are irradiated (FIGS. 21 and 22) since there is produced no force of causing the charged coloring particles 541 themselves to move toward the surface of the transfer medium 501.

When the corona charger is used to irradiate the positively-polarized corona ions 544, that is, those polarized opposite to the charged coloring particles 541 in the ink, the ink image to be obtained varies with the amount of positively-polarized corona ions 544.

This means that when the timing at which corona ions are irradiated is synchronized with the formation of the ink image, the corona ions thus irradiated are accumulated each time the transfer medium 501 rotates once during the formation of the ink image and this makes different the amount of corona ions to be irradiated on each ink image. Therefore, there should be contrived a method of forming a stable ink image without being affected by the amount of corona ions to be irradiated; in other words, the coronaions polarized identically with the charged coloring particles contained in the ink should preferably be irradiated.

When the means for applying a solvent is used to apply the solvent forming the ink to the surface of the transfer medium, the application pressure acts on the charged coloring particles. If identically-polarized corona ions are irradiated, the charged coloring particles 541 will never be disturbed since a strong adhesive force is acting on the charged coloring particles 541 in the ink image 540 with respect to the surface of the transfer medium 501.

On the contrary, the charged coloring particles 541 tends to be disturbed since the adhesive force between the charged coloring particles 541 in the ink image and the surface of the transfer medium 501 is weak when only the small amount of poSitively-polarized corona ions 544, that is, those polarized opposite to the charged coloring particles 541 are irradiated.

When, moreover, the solvent 542 is peeled off the surface of the transfer medium 501 by the force originating from the fluid viscosity to regulate the thickness of the solvent applied, a strong adhesive force acts on the charged coloring particles 541 in the ink image with respect to the surface of the transfer medium 501 if identically-polarized corona ions are irradiated. The charged coloring particles are thus prevented from being peeled off the surface of the transfer medium 501.

If, on the other hand, only a small amount of positively-polarized corona ions 544, that is, those polarized opposite to the charged coloring particles 541 are irradiated, the charged coloring particles 541 tends to be peeled off the surface of the transfer medium 501 since the adhesive force between the charged coloring particles 541 in the ink image and the surface of the transfer medium 501 is weak. Since the force originating from the fluid viscosity is particularly influential in a case when the thickness of the solvent is regulated, the identically-polarized corona ions should be irradiated.

As set forth above, it is effective to contrive a method of forming a stable ink image without being affected by the amount of corona ions to be irradiated, that is, to irradiate the corona ions polarized identically with the charged coloring particles contained in the ink.

What is claimed is:

1. A transfer type ink jet printer, comprising:

an ink jet type record/write means for ejecting ink droplets in which charged coloring particles have been dispersed in a solvent in the form of insulating carrier liquid having a low dielectric constant;

a transfer medium for carrying and moving an ink image formed of ink droplets ejected from said ink jet type record/write means;

a transfer means for transferring the ink image written to said transfer medium on a recording medium by bringing the recording medium in contact with said transfer medium; and a means for temporarily fixing the charged coloring particles in the ink image on said transfer medium until the ink image is led to said transfer means after the ink image is formed on said transfer medium.

2. A transfer type ink jet printer, comprising:

an ink jet type record/write means for ejecting droplets of ink in which charged coloring particles have been dispersed in a solvent in the form of insulating carrier liquid having a low dielectric constant;

a transfer medium for carrying and moving an ink image formed of ink droplets ejected from said ink jet type record/write means;

a transfer means for transferring the ink image written to said transfer medium on a recording medium by bringing said recording medium in contact with said transfer medium;

a means for temporarily fixing the charged coloring particles in the ink image on said transfer medium until the ink image is led to said transfer means after the ink image is formed on said transfer medium; and a means for removing a solvent on said transfer medium with the charged coloring particles temporarily fixed by said fixing means.

3. A transfer type ink jet printer as claimed in claim 2, wherein said removing means comprises a solvent-adsorbent roller having excellent wetting properties with respect to the solvent while rotating in contact with said transfer medium.

4. A transfer type ink jet printer as claimed in claim 2, wherein said removing means comprises a solvent-removing roller having an elastic layer on a surface thereof, rotating in contact with said transfer medium and squeezing the solvent on said transfer medium, and a means for recovering the squeezed solvent on said transfer medium.

5. A transfer type ink jet printer, comprising:

an ink jet type record/write means for ejecting droplets of ink in which charged coloring particles have been dispersed in a solvent in the form of insulating carrier liquid having a low dielectric constant;

a transfer medium for carrying and moving an ink image formed of ink droplets ejected from said ink jet type record/write means;

a transfer means for transferring the ink image written to the transfer medium on a recording medium by bringing said recording medium in contact with said transfer medium;

a means for temporarily fixing the charged coloring particles in the ink image on said transfer medium until the ink image is led to said transfer means after the ink image is formed on said transfer medium;

a means for applying the solvent to the ink image with the charged coloring particles temporarily fixed by said fixing means; and a solvent-thickness regulating means for making the thickness of the solvent constant.

6. A transfer type ink jet printer as claimed in claim 5, wherein said applying means comprises a solvent container for containing the same solvent as what is contained in the ink and a head for applying the solvent, said head having slit through which the solvent in said solvent container is applied to the ink image.

7. A transfer type ink jet printer as claimed in claim 5, wherein said solvent-thickness regulating means, which is situated in said solvent container, comprises a roller for regulating the thickness of a solvent, a peeling plate for removing a solvent adhering to the surface of said roller for regulating the thickness thereof, and race rings attached to both ends of said roller.

8. A transfer type ink jet printer as claimed in claim 5, wherein said applying means is situated opposite to said transfer medium via a very small gap and has a solvent supply slit through which the solvent is supplied to the surface of said transfer medium; and wherein said solvent-thickness regulating means is situated opposite to said transfer medium via a very small gap and has a solvent recovery slit for recovering the solvent supplied by said solvent supply slit to the surface of said transfer medium.

9. A transfer type ink jet printer, comprising:

an ink jet recording head for ejecting droplets of ink in which charged coloring particles have been dispersed in a solvent in the form of insulating carrier liquid having a low dielectric constant;

a transfer medium for carrying and moving an ink image formed of ink droplets ejected from said ink jet recording head;

a transfer means for transferring the ink image written to said transfer medium on a recording medium by bringing said recording medium in contact with said transfer medium;

a means for temporarily fixing the charged coloring particles in the ink image on said transfer medium until the ink image is led t6 said transfer means after the ink image is formed on said transfer medium; and a means for absorbing and removing a solvent on said transfer medium with the charged coloring particles temporarily fixed by said fixing means.

10. A transfer type ink jet printer as claimed in claim 9, wherein said absorbing and removing means has a hole diameter sufficiently smaller than the size of charged coloring particle and is made of a material in the form of a roller for sucking and absorbing the solvent.

11. A transfer type ink jet printer as claimed in claim 9, wherein said absorbing and removing means comprises a roller having a metal mesh layer on the surface and a means for applying voltage between said metal mesh layer and said transfer medium.

12. A transfer type ink jet printer, comprising:

an ink jet recording head for ejecting droplets of ink in which charged coloring particles have been dispersed in a solvent in the form of insulating carrier liquid having a low dielectric constant;

a transfer medium for carrying and moving an ink image formed of ink droplets ejected from said ink jet recording head;

a transfer means for transferring the ink image written to said transfer medium on a recording medium by bringing said recording medium in contact with said transfer medium;

a means for temporarily fixing the charged coloring particles in the ink image on said transfer medium until the ink image is led to said transfer means after the ink image is formed on said transfer medium;

a means for absorbing and removing a solvent on said transfer medium with the charged coloring particles temporarily fixed by said fixing means; and a means for recovering the solvent from said absorbing and removing means.

13. A transfer type ink jet printer as claimed in claim 12, wherein said absorbing and removing means comprises a cylindrical support and a number of metal pins having excellent wetting properties with respect to the solvent, and said recovering means has a number of small holes provided needle-to-needle in said cylindrical support, air blowing outlets arranged inside said cylindrical support and directed to said respective small holes, and a container for recovering the solvent air-blown.

14. A transfer type ink jet printer, comprising:

an ink jet recording head for ejecting droplets of ink in which charged coloring particles have been dispersed in a solvent in the form of insulating carrier liquid having a low dielectric c,onstant;

a transfer medium for carrying and moving an ink image formed of ink droplets ejected from said ink jet recording head;

a transfer means for transferring the ink image from said transfer medium to a recording medium;

a means for temporarily fixing the charged coloring particles in the ink image onto said transfer medium until the ink image is led to said transfer means after the ink image is formed on said transfer medium; and a means for removing a solvent by bringing the solvent on said transfer medium with the charged coloring particles temporarily fixed by said fixing means in contact with water or a surface active aqueous liquid agent.

15. A transfer type ink jet printer, comprising:

an ink jet recording head for ejecting droplets of ink in which charged coloring particles have been dispersed in a solvent in the form of insulating carrier liquid having a low dielectric constant;

a transfer medium for carrying and moving an ink image formed of ink droplets ejected from said ink jet recording head;

a transfer means for transferring the ink image from said transfer medium to a recording medium;

a means for temporarily fixing the charged coloring particles in the ink image onto said transfer medium until the ink image is led to said transfer means after the ink image is formed on said transfer medium;

a means for removing a solvent by bringing the solvent on said transfer medium with the charged coloring particles temporarily fixed by said fixing means in contact with water or a surface active aqueous liquid agent; and a solvent recovery device for recovering the solvent from water or the surface active aqueous liquid agent in said removing means.

16. A transfer type ink jet printer as claimed in claim 15, wherein said removing means comprises a supply slit situated opposite to said transfer medium via a very small gap and used for supplying water or a surface active aqueous liquid agent to the surface of said transfer medium, and a recovery slit situated opposite to said transfer medium via a very small gap and used for recovering the water or the surface active aqueous liquid agent supplied via said supply slit to the surface of said transfer medium.

17. A transfer type ink jet printer as claimed in claim 15, wherein aid solvent recovery device is made of a rotatable solvent-adsorbent material.

18. A transfer type ink jet printer as claimed in claim 1, 2, 5, 9, 12, 14 or 15, wherein said transfer medium is formed with a transfer drum.

19. A transfer type ink jet printer as claimed in claim 1, 2, 5, 9, 12, 14 or 15, wherein said transfer medium is formed with a transfer belt.

20. A transfer type ink jet printer as claimed in claim 1, 2, 5, 9, 12, 14 or 15, wherein said fixing means comprises a means for irradiating an ink image with ions.

21. A transfer type ink jet printer as claimed in claim 1, 2, 5, 9, 12, 14 or 15, wherein said fixing means comprises a means for irradiating an ink image with ions polarized identically with the charged coloring particles.

* * * * *